US011930869B2

(12) United States Patent
Leone et al.

(10) Patent No.: US 11,930,869 B2
(45) Date of Patent: Mar. 19, 2024

(54) PROTECTIVE GEAR

(71) Applicant: Cascade Maverik Lacrosse, LLC, Exeter, NH (US)

(72) Inventors: Holly Dianne Leone, Syracuse, NY (US); David Winthrop Fream, Newfields, NH (US); Ian Hefflefinger, Syracuse, NY (US)

(73) Assignee: Cascade Maverik Lacrosse, LLC, Exeter, NH (US)

( * ) Notice: Subject to any disclaimer, the term of this patent is extended or adjusted under 35 U.S.C. 154(b) by 0 days.

(21) Appl. No.: 17/091,987

(22) Filed: Nov. 6, 2020

(65) Prior Publication Data

US 2021/0195972 A1 Jul. 1, 2021

Related U.S. Application Data

(60) Provisional application No. 62/933,295, filed on Nov. 8, 2019.

(51) Int. Cl.
*A41D 19/015* (2006.01)
*A41D 19/00* (2006.01)

(52) U.S. Cl.
CPC ... *A41D 19/01582* (2013.01); *A41D 19/0006* (2013.01); *A41D 19/001* (2013.01); *A41D 19/002* (2013.01); *A41D 19/01523* (2013.01); *A41D 19/0034* (2013.01)

(58) Field of Classification Search
CPC .... A41D 19/00; A41D 19/006; A41D 19/001; A41D 19/002; A41D 19/0044; A41D 19/0048; A41D 19/015; A41D 19/01517; A41D 19/01523; A41D 19/01582; A41D 19/01588
See application file for complete search history.

(56) References Cited

U.S. PATENT DOCUMENTS 3,416,158 A 12/1968 Kulman
3,605,117 A * 9/1971 Latina ..... A63B 71/143 2/16
3,626,515 A * 12/1971 Murray ..... A63B 71/143 2/16
4,400,829 A * 8/1983 Willis ..... A63B 71/148 D29/113

(Continued)

OTHER PUBLICATIONS

Alibaba Listing, available before Nov. 7, 2019 and retrieved by Examiner at https://www.alibaba.com/product-detail/synthetic-artifical-clarino-leather_60495697769.html on Apr. 22, 2022 (Year: 2019).*

(Continued)

*Primary Examiner* — F Griffin Hall
(74) *Attorney, Agent, or Firm* — Wolf, Greenfield & Sacks, P.C.

(57) ABSTRACT

A glove may include a hand body, the hand body being at least partially elastic, where the hand body defines a hand pocket configured to receive a user's hand, and a wrist body. The glove may also include a hand pad pocket formed in the hand body and configured to removably receive at least one hand pad, where the hand pad pocket is separated from the hand pocket by a separator, as well as a wrist padding pocket formed in the wrist body configured to removably receive a wrist pad. The hand pad pocket may be positioned in an interior of the glove.

27 Claims, 18 Drawing Sheets

(56) References Cited

U.S. PATENT DOCUMENTS 4,484,359 A * 11/1984 Tirinen ..... A41D 19/01523 2/161.1
4,497,073 A * 2/1985 Deutsch ..... A63B 71/143 D29/117.1
4,766,612 A * 8/1988 Patton, Sr. ..... A41D 19/01517 2/163
4,930,162 A * 6/1990 Cote ..... A63B 71/143 2/163
5,237,703 A * 8/1993 Brine ..... A63B 71/143 2/16
5,329,639 A * 7/1994 Aoki ..... A63B 71/143 2/161.1
5,640,712 A 6/1997 Hansen et al.
5,898,938 A 5/1999 Baylor et al.
6,029,277 A 2/2000 Picchione, II
6,275,996 B1 8/2001 Redwood et al.
6,550,069 B1 * 4/2003 Morrow ..... A63B 71/143 2/161.1
6,611,962 B2 9/2003 Redwood et al.
6,959,453 B2 * 11/2005 Best ..... A63B 71/143 2/163
7,086,093 B2 * 8/2006 Carey ..... A41D 19/01529 2/161.6
7,370,373 B2 5/2008 Kohler
7,451,496 B2 * 11/2008 Carey ..... A41D 19/01529 2/160
7,636,951 B2 * 12/2009 Morrow ..... A63B 71/143 2/161.1
7,761,929 B1 7/2010 Mascia
7,774,860 B2 8/2010 Kohler
8,060,949 B2 * 11/2011 Carcaterra ..... A63B 71/143 2/161.6
8,387,168 B2 3/2013 Bautista
8,726,418 B2 5/2014 DeBlasis et al.
8,769,720 B2 7/2014 Aoki et al.
9,101,170 B2 8/2015 Stone et al.
9,113,664 B2 * 8/2015 Copeland ..... A41D 19/01588
10,124,239 B2 * 11/2018 Contant ..... A63B 71/143
2004/0244090 A1 12/2004 Langer
2006/0130210 A1 6/2006 Gait
2006/0130211 A1 6/2006 Gait
2008/0282439 A1 * 11/2008 Sarkies ..... A41D 19/01 2/163
2009/0044306 A1 * 2/2009 Lamson ..... A63B 71/143 2/163
2009/0229035 A1 * 9/2009 Van Hale ..... A41D 19/002 2/163
2010/0192279 A1 8/2010 Hunsicker
2011/0067165 A1 * 3/2011 Fream ..... A63B 71/143 2/161.1
2012/0011633 A1 1/2012 Van Hale
2014/0143924 A1 5/2014 Rusakov et al.
2014/0331376 A1 * 11/2014 Chorne ..... A63B 71/143 2/16
2015/0202521 A1 7/2015 Abdelmalek

OTHER PUBLICATIONS

Invitation to Pay Additional Fees for International Application No. PCT/US2020/059514 dated Dec. 23, 2020.
International Search Report and Written Opinion for International Application No. PCT/US2020/059514 dated Mar. 18, 2021.

* cited by examiner

PROTECTIVE GEAR

CROSS-REFERENCE TO RELATED APPLICATIONS

This application claims priority to U.S. Provisional Application Ser. No. 62/933,295, filed Nov. 8, 2019 and entitled "Protective Gear", the contents of which are incorporated herein by reference in their entirety.

FIELD

Disclosed embodiments generally relate to protective padding for the human body, and more specifically relate to gloves and related methods of use.

BACKGROUND

Padding is typically employed in contact sports to mitigate the forces applied to the body of a player during the course of playing the sport. In conventional padding, pads are integrated into a harness or other support system which is attached or worn on the body. These pads are typically not removable from the harness or other support system.

SUMMARY

In some embodiments, a protective glove includes a hand body, the hand body being at least partially elastic, where the hand body defines a hand pocket configured to receive a user's hand. The glove also includes a wrist body, a hand pad pocket formed in the hand body and configured to receive at least one hand pad, where the hand pad pocket is separated from the hand pocket by a separator, and a wrist pad pocket formed in the wrist body configured to receive a wrist pad.

In some embodiments, a method of assembling first and second gloves, where the first glove includes a hand body of a first hand body type, and the second glove includes a hand body of the same first hand body type as the first glove, each of the first and second gloves having hand pad pocket formed in the hand body, where the hand pad pocket is configured to receive at least one hand pad, and each of the first and second gloves has a wrist pad pocket disposed in a wrist body of the glove, where the wrist pad pocket is configured to receive at least one wrist pad, includes selecting a first hand pad of a first hand pad type. The method also includes placing the selected first hand pad in the hand pad pocket of the first hand body of the first hand body type, selecting a second hand pad of a second hand pad type, and placing the selected second hand pad in the hand pad pocket of the second hand body of the first hand body type.

In some embodiments, a protective glove includes a hand body, the hand body being at least partially elastic, where the hand body defines a hand pocket configured to receive a user's hand, a hand pad pocket formed in the hand body and configured to receive and retain at least one hand pad, where the hand pad pocket is separated from the hand pocket by a separator, and a plurality of raised pads applied to an external surface of the hand body, where the plurality of raised pads includes foam attached to the external surface of the hand body with a heat-welded layer.

In some embodiments, a method of assembling gloves is provided. The gloves each have a hand pad pocket formed in a hand body, and where the hand pad pocket is configured to receive a hand pad, includes selecting a first hand body of a first hand body type, placing a first hand pad in the hand pad pocket of the first hand body, selecting a second hand body of a second hand body type, and placing a second hand pad in the hand pad pocket of the second hand body.

According to another embodiment, a method of assembling a glove is provided. The method includes forming a hand pad pocket in an interior of a hand body, where the hand pad pocket is separated from the hand pocket by a separator. The method further includes placing at least one hand pad in the hand pad pocket and applying a plurality of raised pads to an external surface of the hand body. The plurality of raised pads are applied by heat welding a heat weldable layer to the external surface of the hand body, and foam is positioned between the heat weldable layer and the external surface of the hand body.

According to a further embodiment, a method of assembling a glove is provided. The method includes forming a hand pad pocket on a hand body, where the hand pad pocket is separated from the hand pockets by a separator. The method further includes placing at least one hand pad in the hand pad pocket, where the at least one hand pad includes a first finger pad and a second finger pad, and the first finger pad and second finger pad are connected.

According to yet another embodiment, a protective glove includes a hand body, the hand body being at least partially elastic, wherein the hand body defines a hand pocket configured to receive a user's hand. A hand pad pocket is formed in the hand body and configured to receive and retain at least one hand pad, where the hand pad pocket is separated from the hand pocket by a separator. The at least one hand pad includes a first finger pad and a second finger pad, and wherein the first finger pad and second finger pad are connected.

According to a further embodiment, a protective glove includes a hand body defining a hand pocket configured to receive a user's hand. The glove further includes at least one hand pad positioned on an interior of the hand body, the at least one hand pad including one or more breaks. The glove also includes one or more interstitial portions aligned with the one or more breaks, wherein the one or more interstitial portions are elastic.

According to another embodiment, a method of assembling a glove includes forming a hand body defining a hand pocket configured to receive a user's hand. The method further includes placing at least one hand pad in an interior of the hand body, wherein the at least one hand pad includes one or more breaks. The method also includes providing one or more interstitial portions aligned with the one or more breaks, wherein the one or more interstitial portions are elastic.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
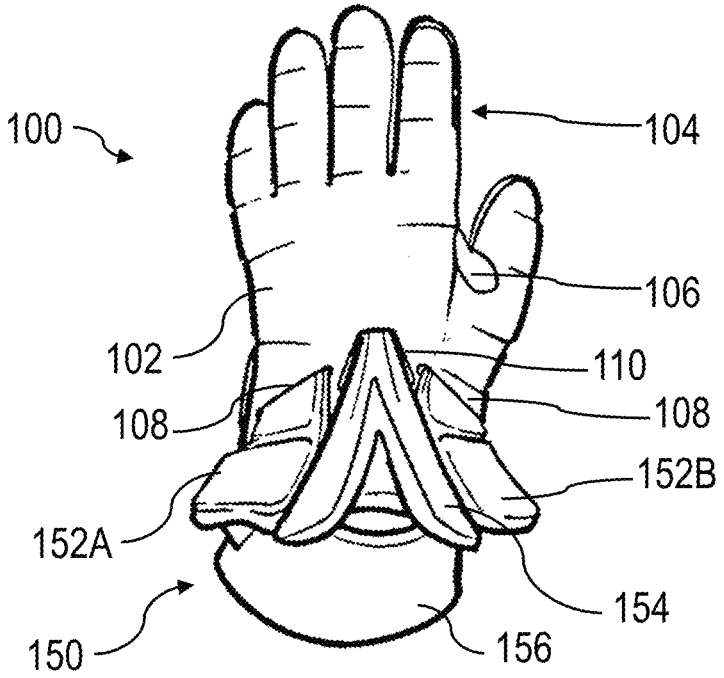
FIG. 1 is a top view of one embodiment of a glove.

Conventional protective sports gear and armor systems for mitigating impact forces on the body typically include one or more pads integrated into a harness or supporting system. The harness or supporting system holds the one or more pads to a user. Because the pads are integrated into the supporting system, each variation for a conventional padding and armor system is manufactured separately. Accordingly, padding and armor systems are typically manufactured as a universal fit or as one or more standard sizes. As a result, customizability and the ability to manufacture custom padding systems are limited with conventional padding systems.

The inventors have recognized the benefits of a padding system having pads which are removable from the supporting systems, such as by being supported in one or more pockets. The inventors have also recognized the manufacturing benefits and order fulfillment and customization benefits of a padding system in which pads are easily inserted into supporting systems such that protective gear may be assembled in an efficient manner. According to some embodiments, a glove having a plurality of pockets to receive pads is provided, and in some embodiments the pads are removable and replaceable after final assembly. In some embodiments, the glove may be at least partially elastic to reliably secure one or more pads inside the pocket as the pads are compressed against a wearer. The padding system of exemplary embodiments described herein allows for rapid order fulfillment and customizability of padding systems, as different sizes, shapes, and types of pads may be employed with a base pad supporting system. The supporting system and pads may be manufactured separately and assembled at a point of sale, a local manufacturing facility, and/or a local distribution center.

In some embodiments, a glove may include a hand body and a wrist body portion, the hand body being at least partially elastic, where the hand body defines a hand pocket configured to receive a user's hand. The glove may also include a hand pad pocket formed in the hand body and configured to removably receive and retain at least one hand pad, where the hand pad pocket is separated from the hand pocket by a separator. That is, the hand pad may be removable from the hand pocket without damaging the pocket or removing permanent or semi-permanent fasteners (e.g., stitching, glue, etc.). The glove also may include a wrist padding pocket formed in the wrist body portion configured to removably receive a wrist pad. In some embodiments, the hand pad pocket is disposed adjacent a dorsal portion of the glove and the hand pocket is disposed adjacent a palmar portion of the glove. In some embodiments, the separator is an elastic layer, and may be formed of a suitable elastic material such as spandex and spandex-like materials. In some embodiments, the dorsal portion of the glove may be elastic and formed of a suitable elastic material.

In some embodiments, hand pockets and wrist pockets may be arranged with openings which facilitate the placement and removal of one or more pads within the pockets. In some embodiments, a hand pad pocket includes a hand pad pocket opening and a wrist pad pocket includes a wrist pad pocket opening, where the hand pad pocket opening and the wrist pad pocket opening are adjacent to one another. In such an embodiment, the pocket openings may be oriented to face each other, such that each pocket extends in a direction opposite one another. Such an arrangement may be well suited to receiving and retaining a single pad in both pockets concurrently. That is, a first end of a pad may be retained in the wrist pad pocket, while a second end of a pad may be retained in the hand pad pocket. Accordingly, a single pad may function as both a hand pad and a wrist pad. In some embodiments, the hand pad pocket opening and wrist pad pocket opening may be positioned adjacent a hand pocket opening, such that the pads are accessible in a region of the glove where a user typically inserts their hand.

In some embodiments, the hand pad pocket or other pockets may be permanently closed after insertion of a pad. For example, a pocket opening may be sewn or heat welded shut after a pad has been inserted into a pocket. In some embodiments, the pocket opening may not be permanently shut, and instead may have an elastic closure or hook and loop fastener to selectively close and open the pocket opening.

In some embodiments, a hand pad pocket and wrist pad pocket may be configured to receive and retain multiple pads. In one embodiment, a plurality of pads may be retained in a hand pad pocket. For example, a pad associated with each finger of a glove may be retained in a continuous pocket. In some embodiments, a hand pad pocket or wrist pad pocket may include two or more sections or dividers which maintain the relative spacing between a plurality of pads disposed in the pocket.

In some cases, ease of insertion of one or more hand pads may be based on the flexibility of the finger portions of a hand pad pocket. That is, resistance to the full insertion of a hand pad may primarily stem from the relatively large amount of surface area contact in the finger portions of the hand pad pocket. Accordingly, in some embodiments, a hand body may include elastic fingertips that expand to assist with the insertion of one or more hand pads. The elastic fingertips may expand to accommodate a distal most portion of one or more hand pads, so that interference between the distal most portion of the one or more hand pads and the hand pad pocket does not inhibit their full insertion into a hand pocket. The elastic fingertips may be formed of a suitably elastic material which may expand in one or more dimensions. For example, in some embodiments the elastic fingertips may be formed of spandex.

In some cases, a hand body may be configured such that definition of the shape of a hand pad inserted into a hand pad pocket of the hand body is not apparent externally. Such a case may occur where the hand pad is configured for flexibility to retain range of motion. However, such flexibility may result in less protection in certain areas of the hand than may be desirable in some cases. Accordingly, the inventors have recognized the benefits of a hand body include a plurality of raised pads applied to an external surface of the hand body. The raised pads may include foam attached to the external surface of the hand body with a heat-welded layer. The heat-welded layer may be formed of any suitable material that may be heat welded to the hand body, including, but not limited, to thermoplastic polyurethane. The plurality of raised pads may be selectively placed on the hand body to provide additional protection in areas of the hand. The plurality of raised pads may be separated from one another, such that the hand body remains exposed in one or more interstitial portions. Accordingly, the flexibility of the hand body may be retained in regions of the hand that move through a large range of motion (e.g., knuckles, fingers, etc.) through the use of these interstitial portions. The plurality of raised pads may also promote visibility of the protective elements of the glove.

In some embodiments, a plurality of raised pads applied to an external surface of a glove may improve the wear characteristics of the glove in one or more regions of the hand. In some embodiments, a hand body may be formed of an elastic material allowing stretch in one or more dimensions. For example, in some embodiments the hand body may be formed of spandex. Accordingly, the hand body may be susceptible to friction wear in certain areas of the glove that undergo significant contact with the ground, other athletes, or equipment during normal use. In some embodiments, the plurality of raised pads may include a heat-welded layer configured to resist wear better than the hand body material. For example, the one or more raised portions may include a heat-welded layer formed of polyurethane (e.g., thermoplastic polyurethane) which may be wear resistant. Of course, any suitable wear resistance material may be employed, as the present disclosure is not so limited. In some embodiments, the plurality of raised pads may include a wear resistant layer including one or more ridges of other texturing that further improves wear characteristics.

In some embodiments, a plurality of raised pads of a glove may be employed to enable rapid customizability of a hand body. As the plurality of raised pads may be applied to an external surface of the hand body, the plurality of raised pads may form the majority of the visible portion of the dorsal section of the glove. Or the raised pads may form the majority of the visible portion of the dorsal section of the fingers. Accordingly, changing one or more characteristics of the raised pads may alter the appearance of the overall glove. As discussed previously, in some embodiments the plurality of raised pads may be formed by attaching foam to an external surface of the glove with a heat-welded layer. Heat welding may allow a hand body to be formed rapidly in a flat configuration, where the plurality of raised pads may be attached simultaneously with a heat press. Different heat-welded layers may be selected to provide different appearances to the hand body. For example, the heat-welded layers may differ in color, texture, graphics, or any other suitable characteristic. Hand bodies may differ in type, where the different in hand body type is based on the type of heat-welded layers of the plurality of raised pads. In this manner, gloves using a consistent underlying hand body and hand pads may be rapidly customized by heat welding a plurality of raised pads to the external surface of the hand body.

It should be noted that while exemplary embodiments described herein are assembled by a heat welding process, other techniques may be employed to assembly a glove. For example, in some embodiments, adhesives or stitching may be employed to form a glove. In some cases, these alternative techniques may be time consuming compared to a heat welding process. Nevertheless, the present disclosure is not so limited to a specific manufacturing or assembly technique.

In some embodiments, one or more pads of different pad types may be employed with the same glove. Pads employed with gloves of exemplary embodiments described herein may differ in size, shape, density, thickness, construction, material, or any other characteristic. For example, a first pad type may have a first thickness and a second pad type may have a second, different thickness. As another example, a first pad type may be formed of a flexible material, and a second pad type may include a plurality of more rigid portions connected by living hinges. As still yet another example, a first pad type may have a first density and a second pad type may have a second, different density. Such an arrangement may allow for gloves and associated padding to be separately manufactured in a first, distant location, and assembled rapidly at a second, local location. According to these embodiments, a customized glove may be rapidly assembled upon receipt of an order, shortening the time to delivery if a customized glove were manufactured as a single integrated glove assembly.

In some embodiments, a method of assembling gloves includes selecting from a plurality of different hand pad types. A first glove may include a hand body of a first hand body type, and a second glove may include a hand body of the same first hand body type as the first glove. Each of the first and second gloves may have a hand pad pocket formed in the hand body, where the hand pad pocket is configured to receive at least one hand pad. The method may include selecting a first hand pad of a first hand pad type, and removably placing the first hand pad in the hand pocket of the first glove. Next, the method may include selecting a second hand pad of a second hand pad type different from the second hand type, and removably placing the second hand pad in the hand pocket of the second glove. In some embodiments, a similar method may occur for additional pads and pockets of the glove, such as a wrist pad pocket. In some embodiments, different glove types may be chosen. For example, a glove having a first set of markings or colors may be selected for a first glove, and a glove having a second set of marking or colors may be selected for a second glove.

In some embodiments, a method of assembling gloves includes selecting from a plurality of different hand body types. A first glove may include a first hand body of a first hand body type, while a second glove may include a second hand body of a second hand body type. The first hand body type and second hand body type may differ in construction texture, color, graphics, or another desirable characteristic. Each of the first and second gloves may have a hand pad pocket formed in the respective hand body configured to receive at least one hand pad. The method may include placing a first hand pad in the first hand body, and placing a second hand pad in the second hand body. In some embodiments, the first hand pad and second hand pad may be of the same hand pad type. In other embodiments, the first hand pad and second hand pad may be of different hand pad types.

Methods according to exemplary embodiments described herein may allow padding systems such as gloves to be rapidly produced at a point of sale or local manufacturing facility, while the bulk of manufacturing of base materials may be performed at a different facility. That is, a first facility may be employed to manufacture base gloves and pads, which may be subsequently shipped in bulk to a local distribution point, point of sale, local warehouse, or manufacturing facility. When a customized order is received, rather than manufacture the entire integrated item at a distant factory, which may result in long lead times, a chosen sleeve and pads may be quickly combined and delivered to a user. Additionally, custom coloring, printing, etc. may be performed on the gloves and/or pads at the local point, allowing customized production and delivery in a short time frame when compared with traditional manufacturing practices. In some embodiments, the base gloves may be manufactured at a first facility, and the pads may be produced at a second facility.

It should be noted that while some exemplary embodiments are described herein as having removable pads, in other embodiments a glove may be configured to receive and retain a pad without allowing the pad to be removed. For example, during an assembly process, a pad may be inserted into a hand pocket through a hand pocket opening. Once the pad is inserted in the hand pocket, the hand pocket opening may be sewn, heat welded, or otherwise fastened so that the pad is not removeable from the hand pocket without damaging the pocket or pocket attachment. Accordingly, the present disclosure is not limited to arrangements where hand pads are removable after an assembly process of the glove.

It should be noted that pockets according to exemplary embodiments described herein may be open along a portion of a perimeter of the pocket. For example, a pocket may be open at one end (e.g., a distal end or a proximal end), open at two opposing ends (e.g., a distal end and a proximal end), or open along one or more portions of a perimeter of the pocket. However, a pocket may also be closed along any portion of the perimeter, including fully closed, to be considered a pocket. Accordingly, the present disclosure is not limited in this regard.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIGS. 1-5 depict different views of one embodiment of a glove 100. As shown in the top view of FIG. 1, the glove includes a hand body 102 which forms an outer layer of the glove and defines a hand pocket which received a user's hand. The hand body includes a plurality of fingers 104, as well as wear portions 106 constructed of a high durability material. The hand body may be constructed of any suitable textile, including knit materials such as nylon. In some embodiments, the hand body may be at least partially constructed of an elastic material, such as spandex or spandex-like materials. As shown in FIG. 1, the hand body includes a hand pad side openings 108 and a central hand pad opening 110. Each of these hand pad openings provide access to a hand pad pocket disposed on a dorsal (e.g., top) side of the hand body 102. The hand pad openings are configured to receive hand pads. According to the embodiment of FIG. 1, the hand pad side openings 108 are configured to receive and removably retain pinky finger side padding 152A and thumb side padding 152B. The central hand pad opening 110 receives and removably retains a middle pad 154. As shown in FIG. 1, when assembled the pads 150 are partially disposed in a hand pad pocket and project outside of the pockets to provide exterior protection to a wrist of the wearer. According to the embodiment of FIG. 1, the glove include a cuff 156 configured to secure the glove to a user's wrist.

Figure 2:
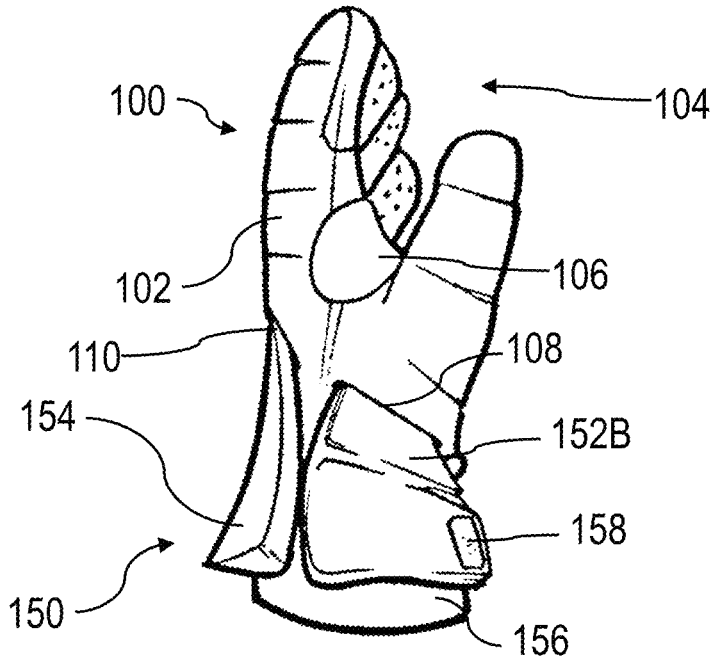
FIG. 2 is a side view of the glove of FIG. 1.

FIG. 2 is a side view of the glove 100 of FIG. 1. As shown in FIG. 2, the cuff 156 is connected the side pads, including the thumb side pad 152B, via buttons 158. That is, the button is passed through a hole formed in the side pads such that the side pad is removably secured to the cuff 156. The cuff may be sized and shaped such that the cuff is not able to be slid over the hand of a user. Accordingly, when removing the glove, the buttons 158 may be detached from the side pads to allow the glove to be more easily removed. The buttons 158 may also inhibit the pads from sliding out of the hand pad pockets formed in the hand body 102, such that the pads and reliably secured until purposefully removed by a user.

Figure 3:
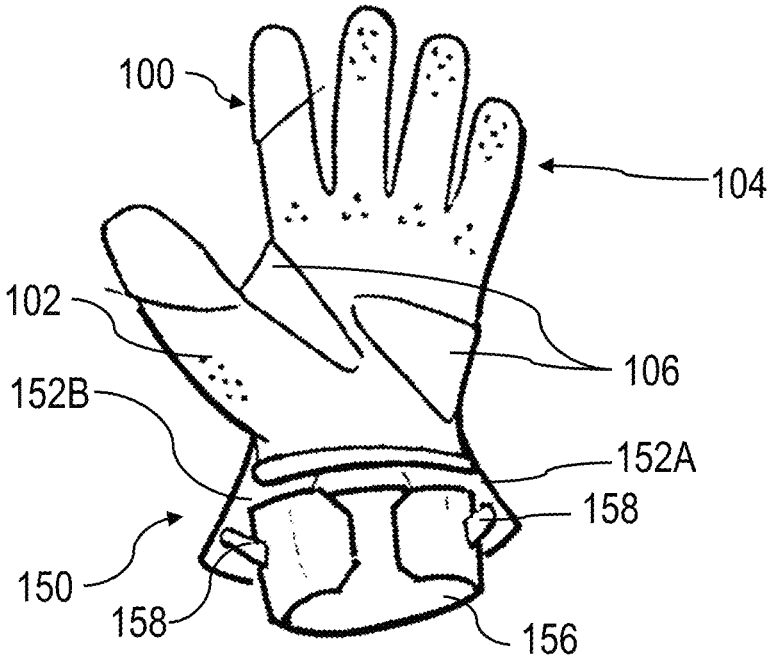
FIG. 3 is a bottom view of the glove of FIG. 1.

FIG. 3 is a bottom view of the glove 100 of FIG. 1. The high wear portions 106 of the glove are shown best in FIG. 3, and in the depicted embodiment are configured to wear in regions specific to the sport of lacrosse. As shown in FIG. 3, the cuff 156 is connected to both side pads 152A, 152B via the buttons 158. According to the embodiment of FIG. 3, the cuff does not form a full circle and includes a cutout, such that the cuff may be removably secured to the wrist of a user. When removed, the cuff may simply be deformed to open the cutout to an extent suitable to extract the wrist.

Figure 4:
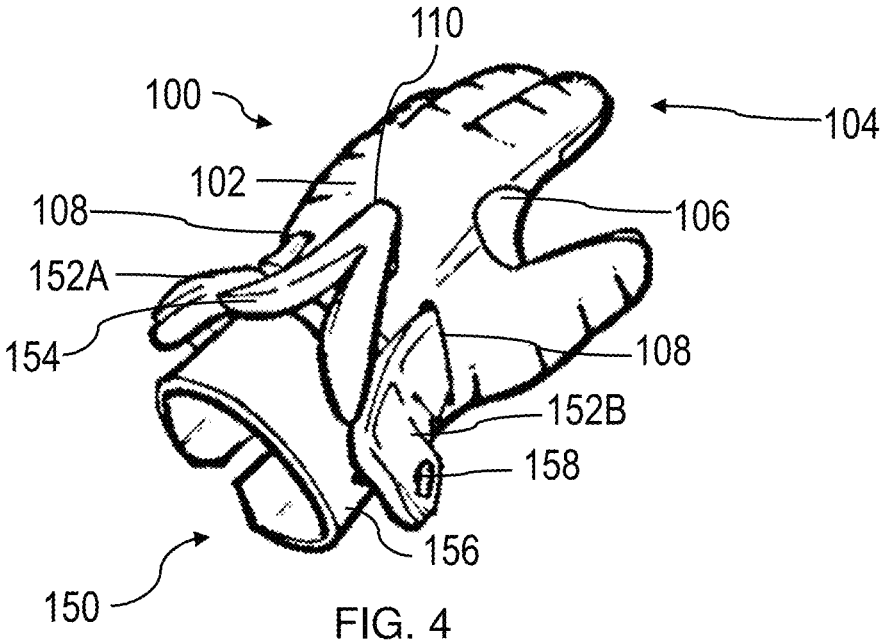
FIG. 4 is a perspective view of the glove of FIG. 1.

FIG. 4 is a perspective view of the glove 100 of FIG. 1. As shown in FIG. 4, the side pads 152A, 152B extend out of the hand pad side openings 108. Likewise, the central pad 154 extends out of the central hand pad opening 110. The side pads and central pads provide protection for a dorsal side of the glove 100, and are disposed in a pocket separated from a hand opening by a separator layer.

Figure 5:
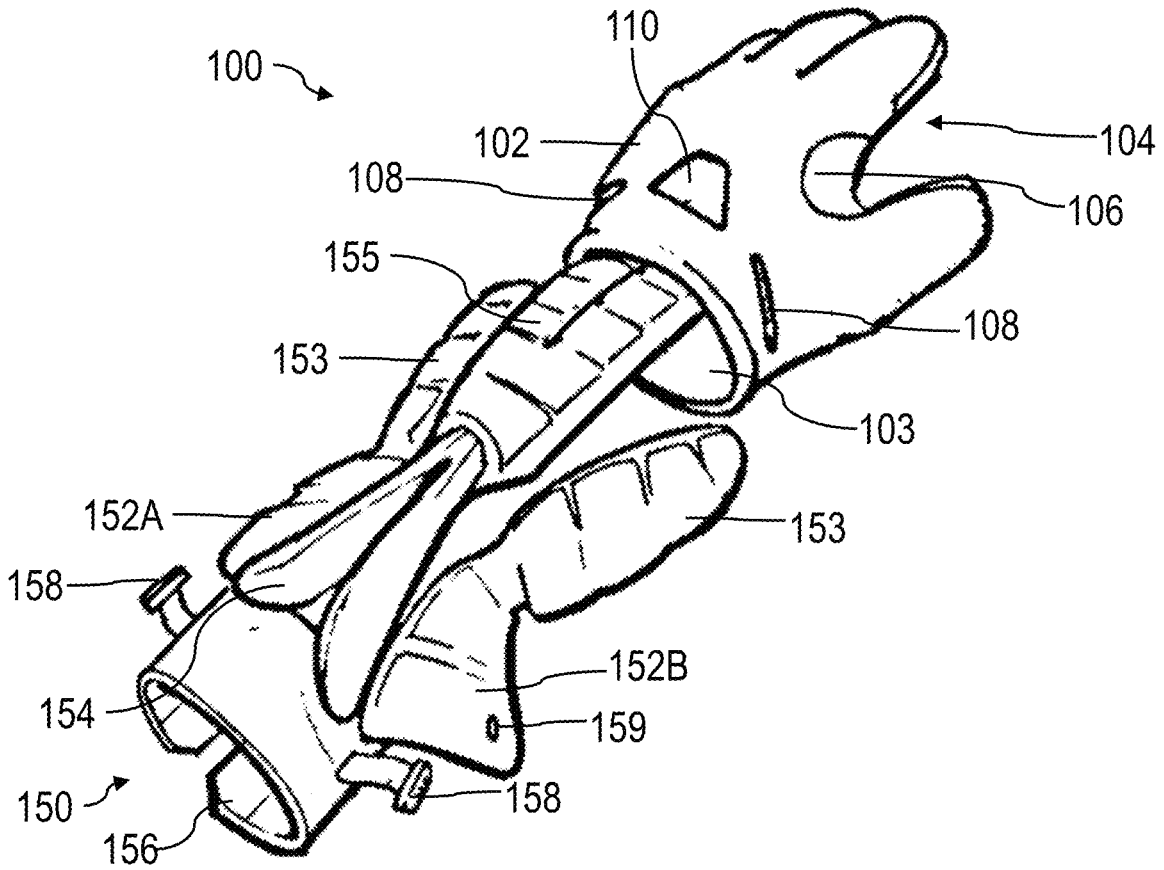
FIG. 5 is an exploded view of the glove of FIG. 1.

FIG. 5 is an exploded view of the glove 100 of FIG. 1 showing each of the individual components of the glove separately. As shown in FIG. 5 the hand body 102 defines a hand pocket 103 configured to receive a wearers hand. The side pads 152A, 152B and central pad 154 are configured to be inserted into pockets formed in the hand body 102. In particular, finger portions 153, 155 of each of the pads are inserted into pockets to align with the fingers 104 of the hand body. As noted previously, the cuff 156 is secured to the side pads 152A, 152B with buttons 158 when the buttons are passed through holes 159.

Figure 6:
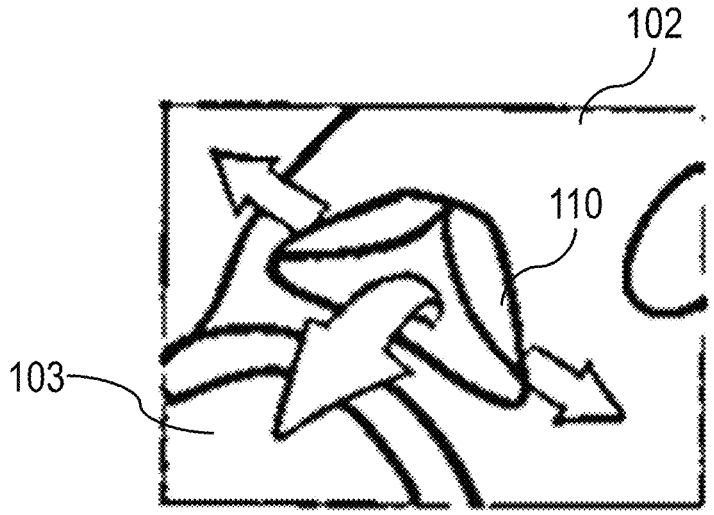
FIG. 6 is an enlarged view of a hand pad pocket opening of the glove of FIG. 1.

FIG. 6 is an enlarged view of a hand pad pocket opening 110 of the glove of FIG. 1. As shown in FIG. 6, the hand pad opening 110 is formed in a trapezoidal shape, and allows a central pad 154 to be inserted and removed from a hand pad pocket formed in the hand body 102. The hand pad pocket may be separated from a hand pocket 103, such that a user's hand is not in direct contact with the pads. Of course, in some embodiments a user's hand may contact the pad, as the present disclosure is not so limited. In some embodiments, the hand pad opening 110 may be sized to be smaller than the pad inserted through the hand pad opening. That is, the hand pad may be suitably flexible to deform and/fold through the opening, whereas in a resting position the hand pad may not fit through the opening. Such an embodiment may be beneficial to removably retain a pad inside of a hand pad pocket. In some embodiments, the hand pad pocket opening 110 may include elastic or another material configured to stretch to accommodate entry or removal of a pad.

Figure 7:
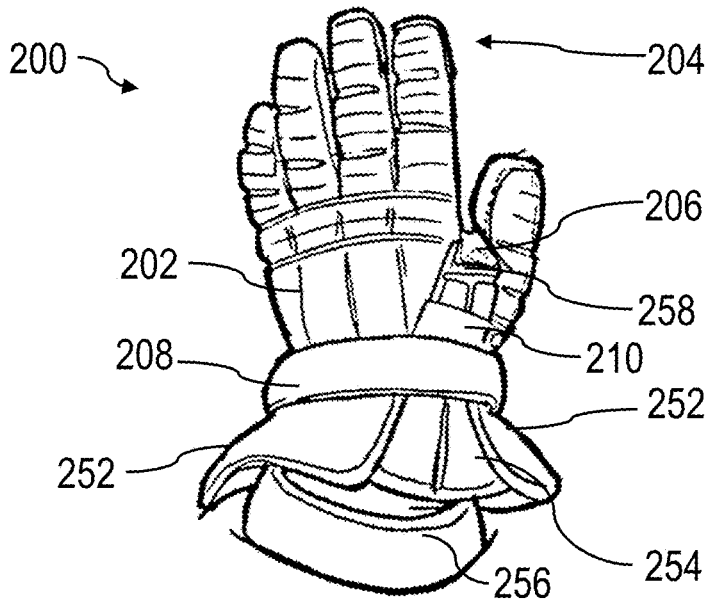
FIG. 7 is a top view of another embodiment of a glove.

FIGS. 7-11 depict different views of another embodiment of a glove 200. Similar to the previously discussed embodiment, the glove includes a hand body 202 which defines a hand pocket configured to receive a user's hand. The hand body includes fingers 204 for receiving each finger of a user's hand. However, in contrast to the prior embodiment, the glove of FIGS. 7-11 includes detachable wrist padding 208. The detachable wrist padding 208 includes side pads 252 and a central pad 254 which extends toward a thenar webspace (i.e., the portion of the glove between a thumb and index finger) area of the glove. There, a central pad coupler 258 is attached to a hand body coupler 206. In some embodiments, the coupler may include hook and loop fasteners, snap button fasteners, or any other suitable fastener. The glove also includes a strap 210 configured to engage the wrist padding 208 and apply tension to the hand body to adjust the fit of the glove on a user, as will be discussed further with reference to FIG. 8. As shown in FIG. 7, the glove also includes a cuff 256 which is configured to releasably attach to the side pads 252 with buttons, as shown best in FIG. 10.

Figure 8:
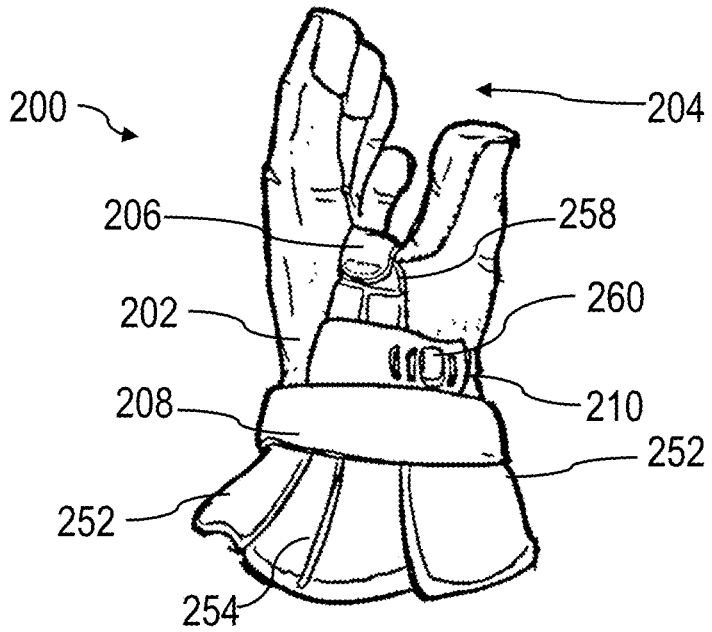
FIG. 8 is a side view of the glove of FIG. 7.

FIG. 8 is a side view of the glove 200 of FIG. 7. As shown in FIG. 8, the strap 210 may be used to adjust the diameter of the glove, and to secure the glove to the hand of a user. The strap is configured to engage both a portion of the central pad 254 and a catch 260 which is configured to engage one of a plurality of attachment locations on the strap. Accordingly, the effective length and tension on the strap may be adjusted to a desirable amount. Tensioning the strap 210 may also close the glove around the base of a user's hand to secure the glove on the hand.

Figure 9:
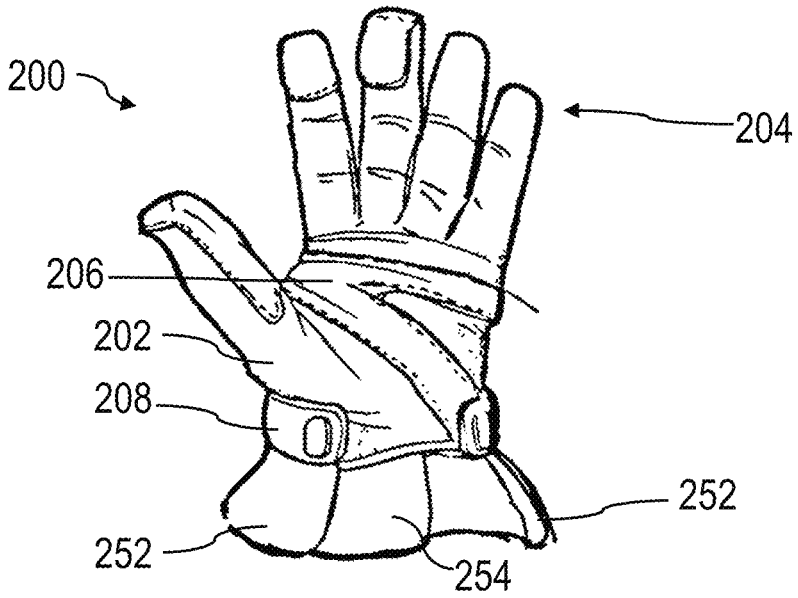
FIG. 9 is a bottom view of the glove of FIG. 7.

FIG. 9 is a bottom view of the glove 200 of FIG. 7. As shown in FIG. 9, the hand body coupler 206 may extend across a palmar portion of the glove 200. The hand body coupler may be formed of a suitably durable material, as the hand body coupler may also function as a high wear region of the glove.

Figure 10:
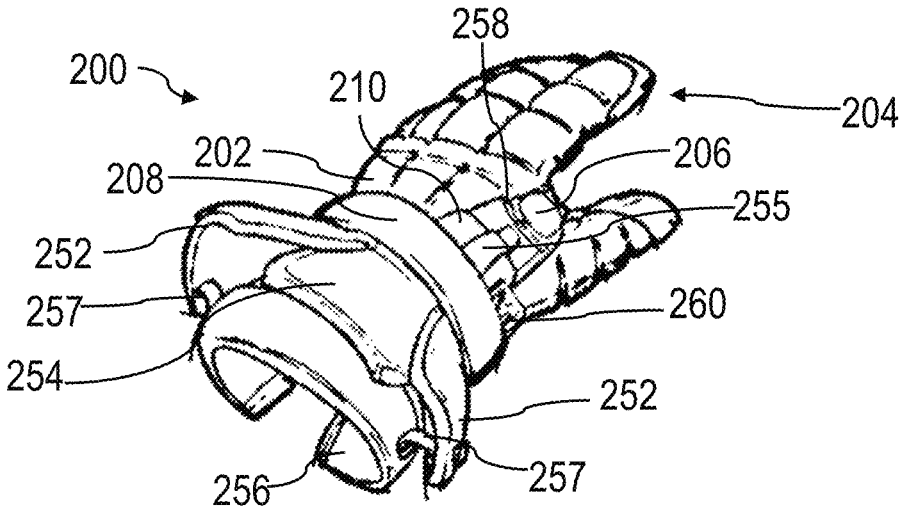
FIG. 10 is a perspective view of the glove of FIG. 7.

FIG. 10 is a perspective view of the glove 200 of FIG. 7. As shown in FIG. 10, the glove 200 includes a cuff 256 which is similar to the cuff of the embodiment of FIGS. 1-5. That is, the cuff 256 includes a cutout configured to allow a user's wrist to be received and reliably secured inside of the cuff. The cuff 256 is attached to the side pads 252 with buttons 257 that pass through holes formed in the side pads 252. As shown in FIG. 10, the central pad 254 includes a clip 255 which is configured to attach to the strap 210. The clip 255 may be an elastically deformable clip which releasably retains the strap 210. Accordingly, the clip may secure the detachable wrist padding 208 to the hand body 202.

Figure 11:
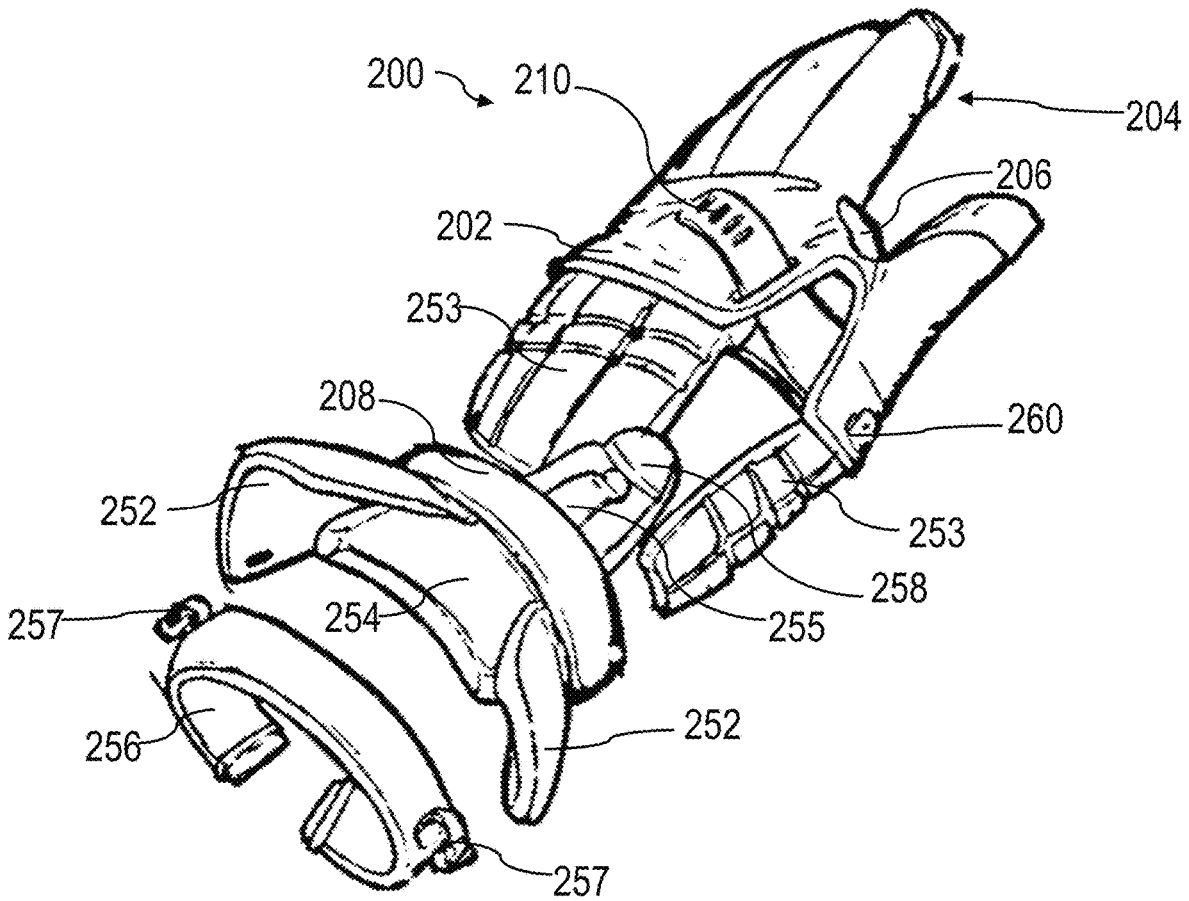
FIG. 11 is an exploded view of the glove of FIG. 7.

FIG. 11 is an exploded view of the glove 200 of FIG. 7 showing internal padding and each element of the glove 200. The glove includes a hand body 202 which is adjustable with a strap 210. A hand body coupler 206 is configured to receive a central pad coupler 258 and secure deployable wrist padding 208 to the hand body 202. A clip 255 of the removable wrist padding also assists in releasably retaining the wrist padding on the glove, as the clip engages the strap 210. The glove includes hand padding 253 which is configured be received and retained, in some embodiments removably, in one or more hand pad pockets which are positioned within an interior of the hand body 202. According to the embodiment of FIG. 11, the hand pads include a dorsal hand pad and a thumb hand pad. Of course, any suitable number of pads may be employed, as the present disclosure is not so limited.

Figure 12:
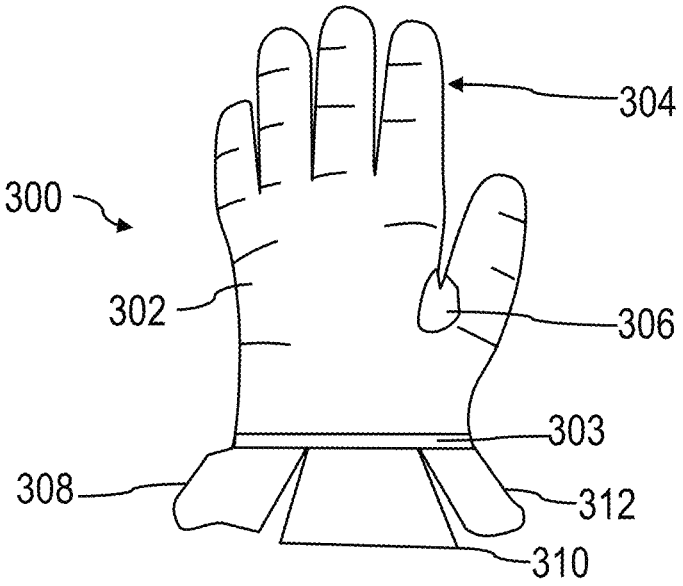
FIG. 12 is a top view of yet another embodiment of a glove.

FIG. 12 is a top view of yet another embodiment of a glove 300. As shown in FIG. 12, the glove includes a hand body which includes a hand pocket configured to receive a hand of a user. The hand body has a plurality of fingers 304, as well as high wear portions 306. According to the embodiment of FIG. 12, the glove includes a wrist body 303 integrated with the hand body 302 such that they form a single piece. The wrist portion is divided into a first section 308, a second section 310, and a third section 312. As will be discussed further with reference to FIG. 13, the glove includes a plurality of wrist pad pockets and a hand pad pocket configured to removably receive and retain pads.

Figure 13:
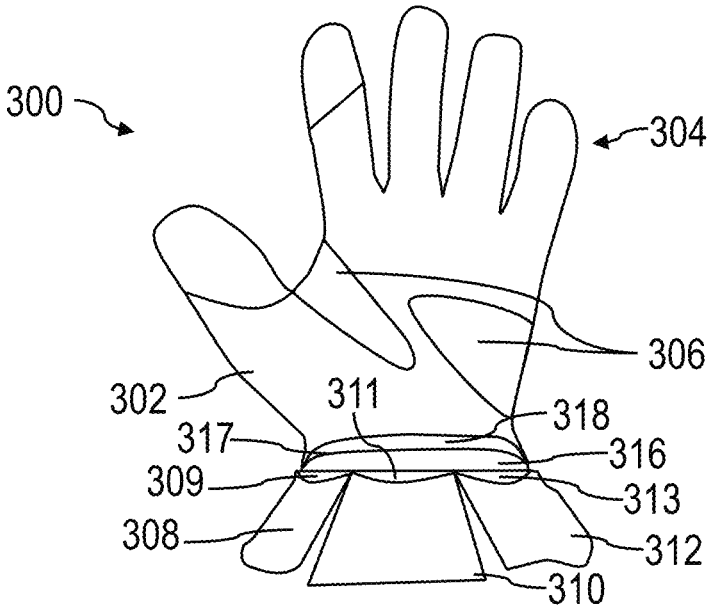
FIG. 13 is a bottom view of the glove of FIG. 12.

FIG. 13 is a bottom view of the glove 300 of FIG. 12 showing the arrangement of the pockets in the glove. As shown in FIG. 13, the glove includes a hand pocket 318 formed on a palmar side of the glove. The hand pocket is separated from a hand pad pocket 316 by a separator 317. The separator may be a piece of fabric which effectively separates the hand pad pocket to a dorsal side of the glove. In some embodiments, the separator is elastic and formed of a spandex or spandex-like material. As shown in FIG. 13, each of the wrist portion sections 308, 310, 312 includes a wrist pad pocket. That is, the first wrist section includes a first wrist pad pocket 309, the second section includes a second wrist pad pocket 311, and the third section includes a third wrist pad pocket 313. As shown in FIG. 13, the openings of the wrist pad pockets and the hand pad pocket are oriented toward each other. That is, they are adjacent to one another and the hand pad pocket and wrist pad pockets extend away from each other in opposite directions. Additionally, the hand pocket is adjacent to the hand pad pocket, such that the pads may be inserted or removed at a location near where the hand is inserted or removed from the hand pocket. As will be discussed further with reference to FIGS. 14-15, such an arrangement allows single piece pads to extend into the hand body 302 and wrist body 303 to provide protection for both.

According to the embodiment of FIG. 13, the wrist pad pockets 309, 311, 313 and hand pad pocket 316 may be configured to retain flexible single piece pads. That is, a single pad may extend from each wrist pad pocket to the hand pad pocket 316. To insert the pads, a first end of the pad may be inserted into the hand pad pocket 316. Next, the pad may be folded or deformed such that the second end of the pad may be inserted into a wrist pad pocket. Once in the pockets, the pad may be secured in a resting state. Of course, in some embodiments, the hand pad pocket and wrist pad pockets may receive separate pads, as the present disclosure is not so limited.

Figure 14:
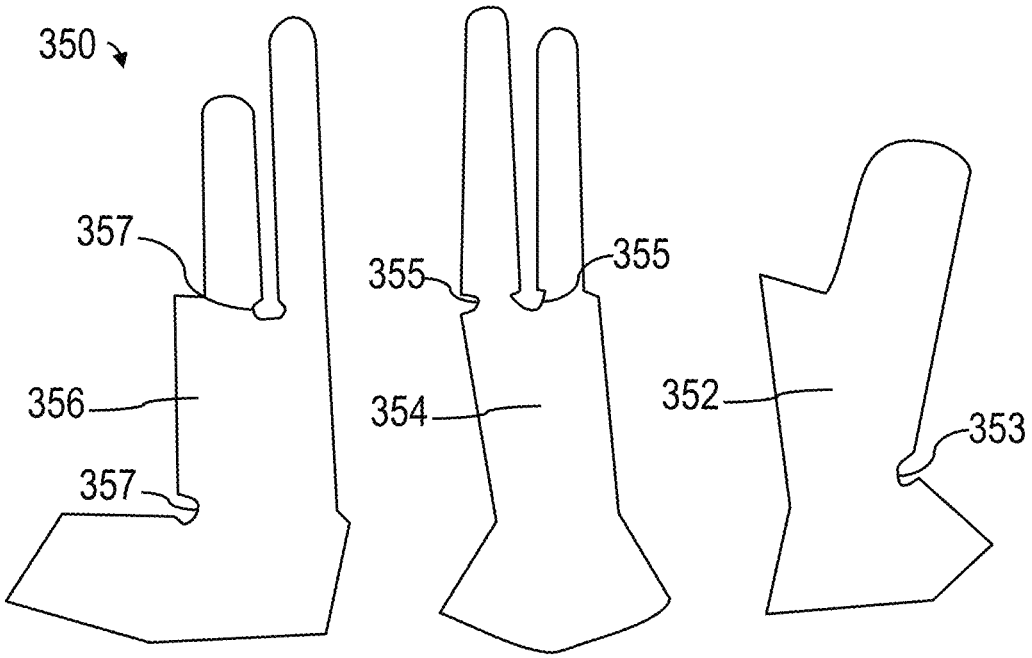
FIG. 14 depicts one embodiment a glove padding.

FIG. 14 depicts one embodiment a glove padding 350 for use with a glove like that of FIGS. 12-13. According to the embodiment of FIG. 14, the glove padding may be flexible to allow for movement of the hand. The glove padding also includes portions that protect a dorsal portion of the glove and portions that extend into wrist pad pockets and protect a wrist portion of the glove. According to the embodiment of FIG. 14, the padding 350 is split into three portions: a thumb pad 352, an index pad 354, and a pinky pad 356. Each of the pads are cut such that when they are disposed in corresponding hand pad pocket and wrist pad pockets they deform to match the shape of the glove and/or hand. As shown in FIG. 14, the thumb pad includes flex region 353 to promote flexibility of the pad to inhibit bunching. Likewise, the index pad includes flex regions 355 and the pinky pad includes flex regions 357 that function similarly.

While in the embodiment of FIG. 14 the glove padding 350 is the same thickness throughout. In some embodiments the glove padding may include one or more breaks extending at least partially through the thickness of the padding. The one or more breaks may provide additional flexibility, as the thinner material may function as a living hinge. In some embodiments, the one or more breaks may be configured to be aligned with knuckle regions of a glove configured to receive the glove padding. The knuckle regions of a glove may be configured to bend when a finger of the glove is bent. Accordingly, the one or more breaks may provide added flexibility in regions of the glove intended to bend.

Figure 15:
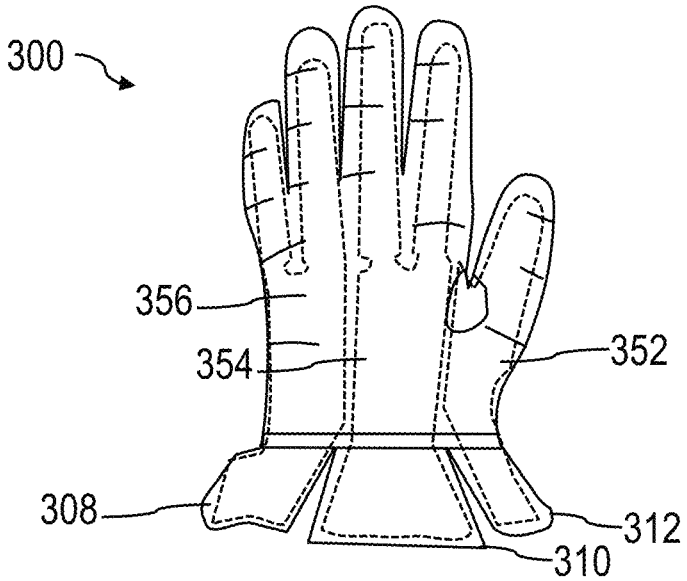
FIG. 15 is a top view of the glove of FIG. 12 removably retaining the padding of FIG. 14.

FIG. 15 is a top view of the glove of FIG. 12 removably retaining the padding of FIG. 14. As shown in FIG. 15, the thumb pad 352, index pad 354, and pinky pad 356 are disposed in the glove 300. The pads may be suitable flexible to adopt the shape of the glove. The pads extend into both the hand body and the wrist body sections and are retained passively inside of the pockets.

In some embodiments, systems and methods of exemplary embodiments described herein may be applied to padding systems for a variety of different body portions. In some embodiments, a padding system includes an elastic body having a first pocket disposed in a first interior portion of the elastic body, such as a hand body of a glove. The first pocket may include a first pocket opening configured to receive at least one first pad. The padding system may also include a second pocket disposed in a second interior portion of the elastic body, where the second pocket includes a second opening configured to receive at least one second pad. The first pocket and second pocket may each be configured to receive a plurality of different pad types, where the different pad types vary in size, shape, and/or construction.

An elastic body of a padding system may be formed in a shape configured to accommodate any portion of a user's body where is may be desirable to removably attach one or more pads to the body portion. In some embodiments as described previously, an elastic body may be configured as an arm sleeve. In other embodiments, an elastic body may be configured as an arm sleeve, shirt, leg sleeve, or any other appropriate shape to accommodate a body portion. The elastic body in any of these shapes may include one or more internal pockets configured to removably receive and retain a corresponding pad.

In some embodiments, a method of assembling a padding system includes selecting one first pad type from a plurality of first pad types. For example, a plurality of first pads may include rigid pads and pads having a plurality of living hinges. As another example, a plurality of first pads may include pads with a first density and pads with a second density different from the first density. The method may also include removably placing the selected type of first pad in a first pocket of an elastic body such as a hand body of a glove. Placing the first pad in the first pocket may include sliding the first pad into the first pocket via a pocket opening disposed on an interior of the elastic body (e.g., hand body of a glove). The method may also include one second pad type from a plurality of second pad types. Similarly to the first pad, a plurality of second pads may be a variety of types which differ in size, shape, and/or construction. The method may also include removably placing the selected type of second pad in a second pocket. Like the first pocket, the second pocket may include an opening disposed on an interior of the elastic body through which the second pad can be inserted into the second pocket.

Figure 16:
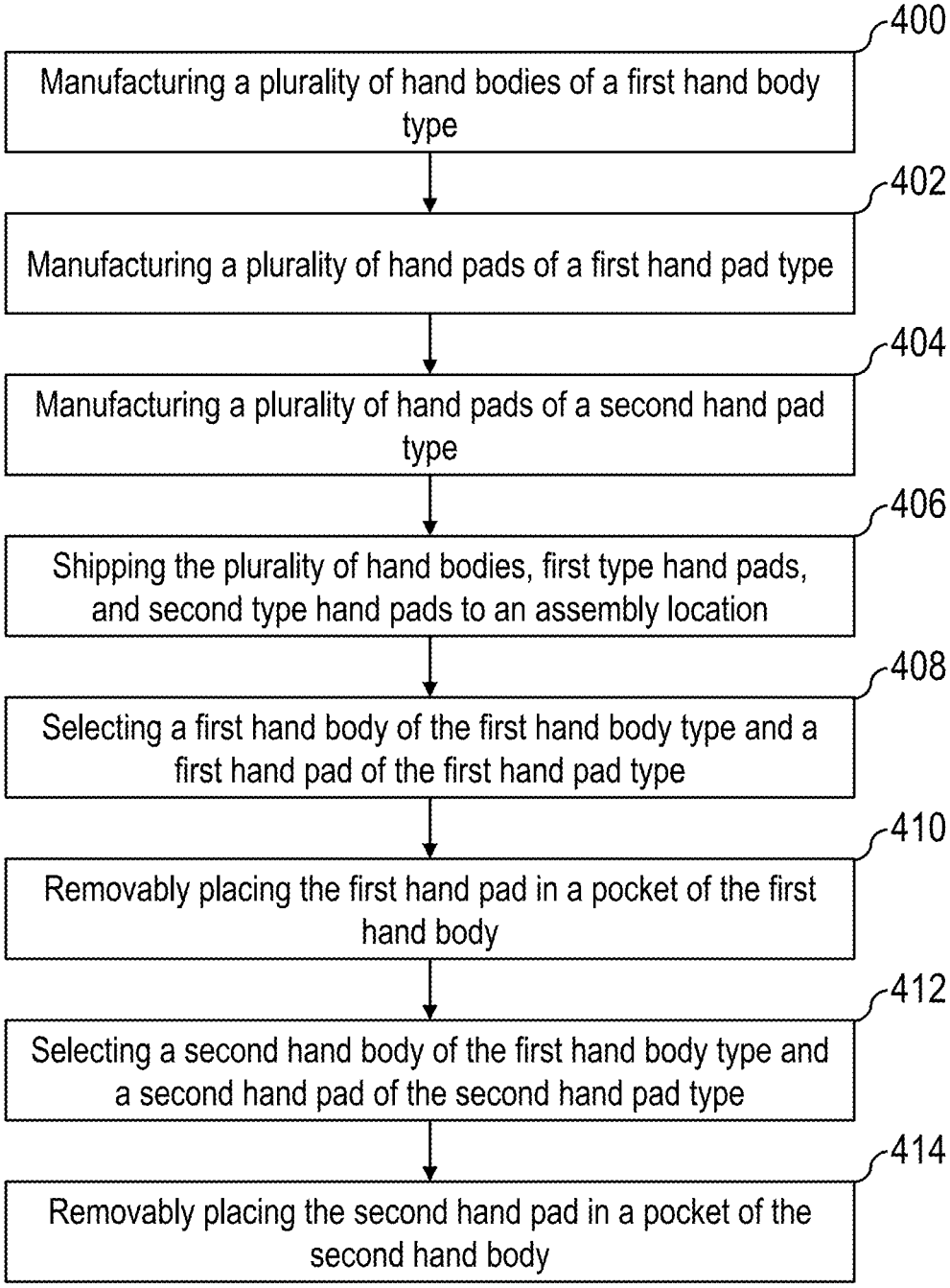
FIG. 16 is a flow chart for one embodiment of a method of producing a protective glove.

On embodiment of a method of assembling a protective glove is shown in the flow chart of FIG. 16. As shown in FIG. 16, the method starts with manufacturing a plurality of hand bodies of a first hand body type at block 400. Next, a plurality of hand pads of a first hand pad type are manufactured at block 402, and a plurality of hand pads of a second hand pad type are manufactured at block 404. It should be noted that while the steps in block 400, 402, and 404 are shown as occurring in sequence, in some embodiments the manufacturing steps may occur in any order or in parallel. At block 406, the plurality of hand bodies, hand pads of the first hand pad type, and hand pads of the second hand pad type are shipped to an assembly location. In some embodiments, the various components of the protective glove may be manufactured in a first location and shipped to an assembly location different from the first location. For example, the manufacturing may be performed in a first country or region, and the assembly location may be in a second different country or region. Such an arrangement may be beneficial to balance supplying the raw materials and labor for manufacturing, and reducing final shipping time by having the gloves assembled nearer an end customer. At the assembly location, the steps 408-414 may be performed. Accordingly, in some embodiments, the steps of 400-406 and the steps of 408-414 may be part of a separate method performed by different individuals, groups, or corporations.

As shown in FIG. 16, at block 408 a first hand body of the first hand body type may be selected from the plurality of hand bodies. A first hand pad of the first hand pad type is also selected from the plurality of hand pads. At block 410, the first hand pad may be removably placed in a pocket of the first hand body. Placing the first hand pad in the pocket may also removably retain the hand pad in the pocket without permanently or semi-permanently affixing the pad to the hand body (e.g., through stitching, glue, etc.). At block 412, a second hand body of the first hand body type is selected. A second hand pad of the second hand pad type is also selected. At block 414, the second hand pad is removably placed in a pocket of the second hand body. Similar to the pocket of the first hand body, the pocket of the second hand body may retain the second hand pad in the pocket without permanent or semi-permanent retainers. In some embodiments, a releasable retainer (e.g., button, hook and loop fastener, zipper, etc.) may be employed to retain the second hand pad in the pocket. Alternatively, as discussed previously, the arrangement of the pocket itself may retain the second hand pad in the pocket. According to the method shown in FIG. 16, two protective gloves of different types are produced. That is, the method produces a first protective gloving having a first hand body type and a first hand pad type and a second protective glove having a first hand body type and a second hand pad type. Accordingly, the first hand pad type is suitable to receive a plurality of different padding types, such that different types of gloves may be produced rapidly using a base hand body type. A block diagram showing the flexibility of the method described herein is shown in FIG. 17 and discussed further below.

Figure 17:
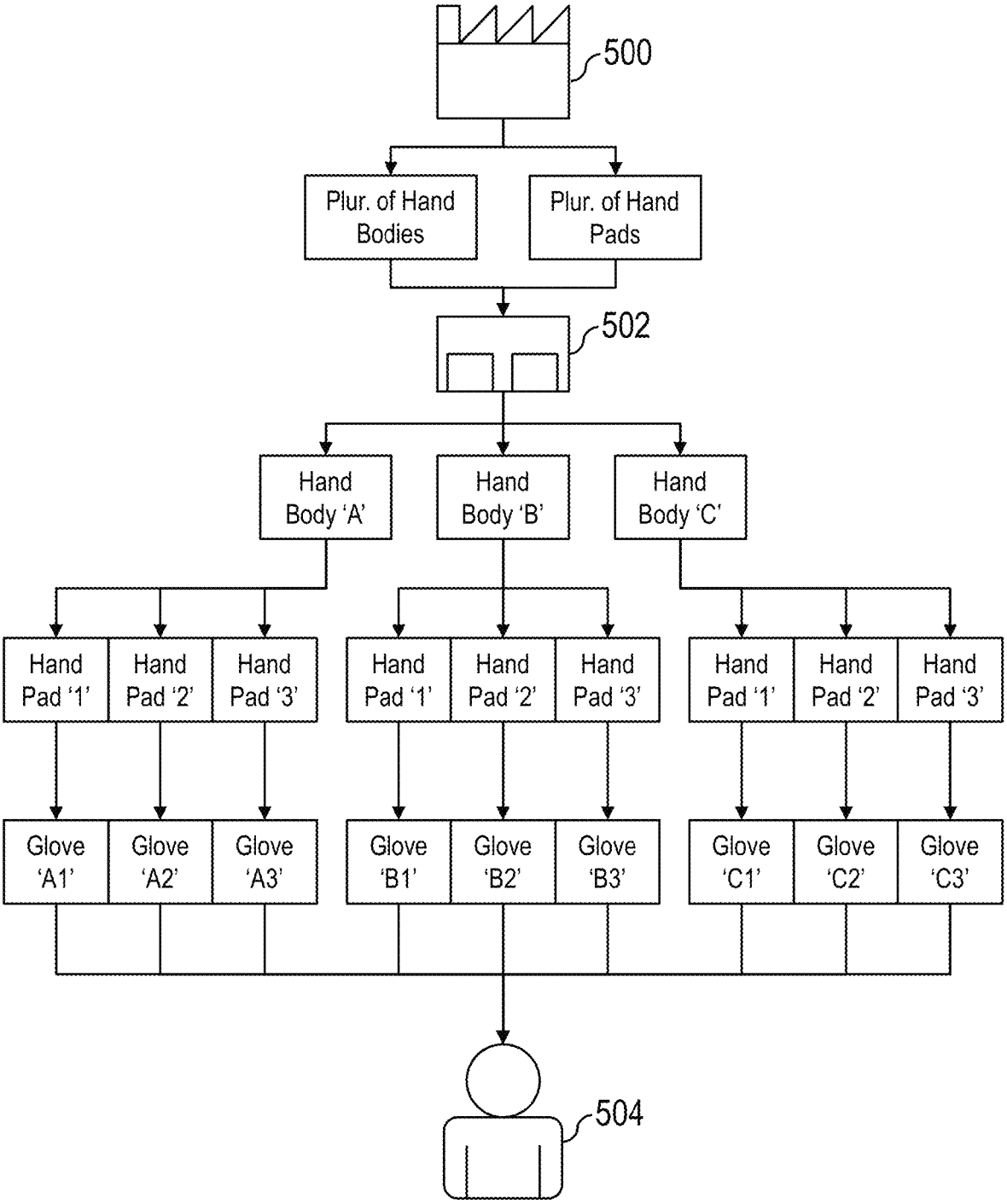
FIG. 17 is a block diagram of one embodiment of a manufacturing and assembly process for a plurality of protective gloves.

FIG. 17 is a block diagram of one embodiment of a manufacturing and assembly process for a plurality of protective gloves of different variants. According to exemplary embodiments described herein, a protective glove may include one or more pockets configured to releasably receive and retain one or more protective pads. The protective glove pockets may be configured such that they are able to receive a plurality of different protective pad types. For example, the protective pads may vary in density, rigidity, construction, or any other suitable characteristic, such that different overall gloves may be producing having a variety of performance levels with associated cost levels. While gloves of different performance levels and prices are conventionally produced, these gloves are often produced as unitary products at locations far from the end customer (e.g., overseas). Accordingly, lead times for custom variations of products may take months depending on demand and other factors. The gloves and methods described herein allow a plurality of modular components to be produced at a first location, and assembly to occur at a second location closer to the end customer. As the protective gloves are modular in nature and the glove pockets are configured to accommodate a plurality of different types, customizing a glove may be as straightforward as selecting a hand body type and a hand pad type, and placing the hand pad in the hand body. The inventors have appreciated that many different varieties of gloves may be produced by such a method, allowing for near full customizability on a short lead time (e.g., 48 hours).

As shown in FIG. 17, a plurality of hand bodies and a plurality of hand pads may be manufactured at a manufacturing facility 500. According to the embodiment depicted in FIG. 17, the plurality of hand bodies may include three types: A, B, and C. The hand body types may differ in materials (e.g., synthetics vs. leather), construction (e.g., switching patterns), features (e.g., adjustability, wear regions, raised pads, etc.), size, color, and/or any other appropriate characteristic. It should be noted that the number of hand body types is not limited to three, and any suitable number of hand body types may be employed in the depicted process. According to the embodiment depicted in FIG. 17, the plurality of hand pads include three types: 1, 2, and 3. The hand pad types may differ in materials (e.g., plastics, high-density foam, medium density foam, low density foam, etc.), construction (e.g., molded, die cut, etc.), features (e.g., articulation regions, wear regions, etc.), size, and/or any other appropriate characteristic. It should be noted that the number of hand pad types is not limited to three, and any suitable number of hand body types may be employed in the depicted process.

As shown in FIG. 17, the plurality of hand body types and hand pad types are delivered to an assembly facility 502. At the assembly facility, the final protective gloves are produced. As discussed previously, the assembly facility 502 may be in a different location than the manufacturing facility 500. Of course, in some embodiments, the assembly facility 502 and manufacturing facility 500 may be in the same or similar locations, and may even be the same facility, as the present disclosure is not so limited. As shown in FIG. 17, the hand body types A, B, and C may each be combined with the hand pad types 1, 2, and 3. That is, in some embodiments, each of the hand body types may include a pocket configured to receive and retain each of the hand pad types. Accordingly, the hand pad types may be joined with the hand body types to create nine different variants of protective gloves: A1, A2, A3, B1, B2, B3, C1, C2, and C3. Each of these different glove types may be delivered to an end customer 504 or a retail location. According to some embodiments, the assembly process may have a short lead time, and a glove of a particular variant may be assembled on demand once an order is received (e.g., from end customer 504). In some cases, the production of a glove of a particular variant may take 48 hours or less, compared to traditional manufacturing lead times of 6 weeks or more.

It should be noted that while the embodiment of FIG. 17 depicts gloves that include one hand body and one hand pad, in other embodiments a glove may include a hand body that receives of plurality of different hand pads. For example, as discussed above with reference to FIGS. 12-15, the hand body may include a plurality of different hand pads for different portions of the hand body. For example, in some embodiments, a hand body may include a pocket for each finger, and a pocket for a dorsal region of the hand for receiving six total hand pads. Of course, other embodiments are contemplated using any suitable number of hand pads, as the present disclosure is not so limited.

In some embodiments, the process shown in FIG. 17 may also include a customization process, whereby the hand body and/or hand pads may have colors, logos, or other visual features applied during the assembly process at the assembly location. For example, each of the different hand body types may be well suited to receive printed colors, logos, or icons prior to combination with the hand pads. Likewise, hand pads which may be disposed partially outside of the hand body may also receive printed images or colors. Of course, any suitable method may be employed to provide visual customization for a hand body and/or hand pad, as the present disclosure is not so limited.

In some embodiments, hand pads of various types may be constructed of different methods. For example, in some embodiments, a hand pad may be constructed via molding. In such an embodiment, a single piece hand pad that fully protects the hand may be produced and combined with a hand body of one or more types. In some cases, the hand pad may be disposed partially on an exterior of the glove, such that is visible by a user when worn. Of course, any suitable method of producing protecting padding may be employed, such as die cutting, as the present disclosure is not so limited.

Figure 18A:
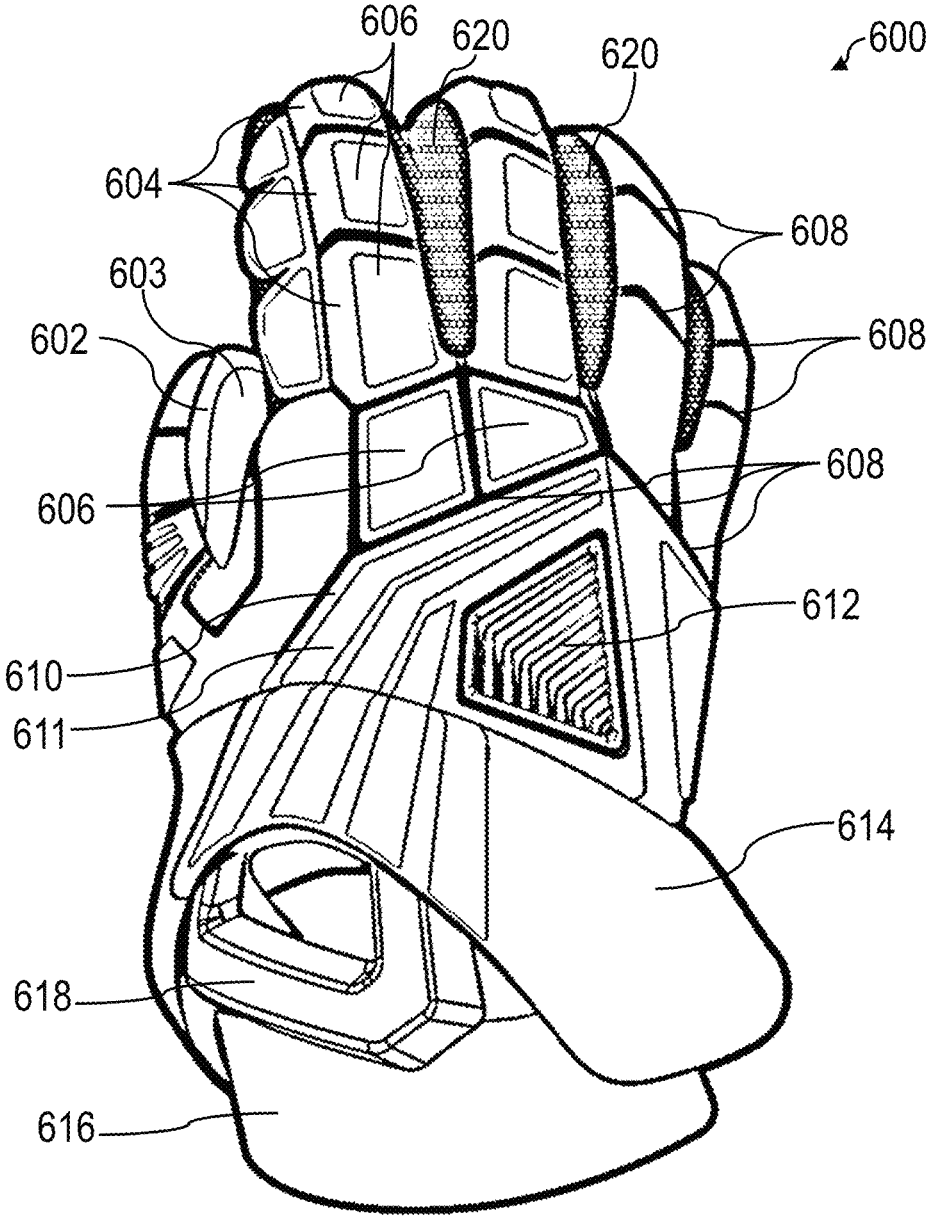
FIG. 18A is a dorsal view of another embodiment of a glove.
Figure 18B:
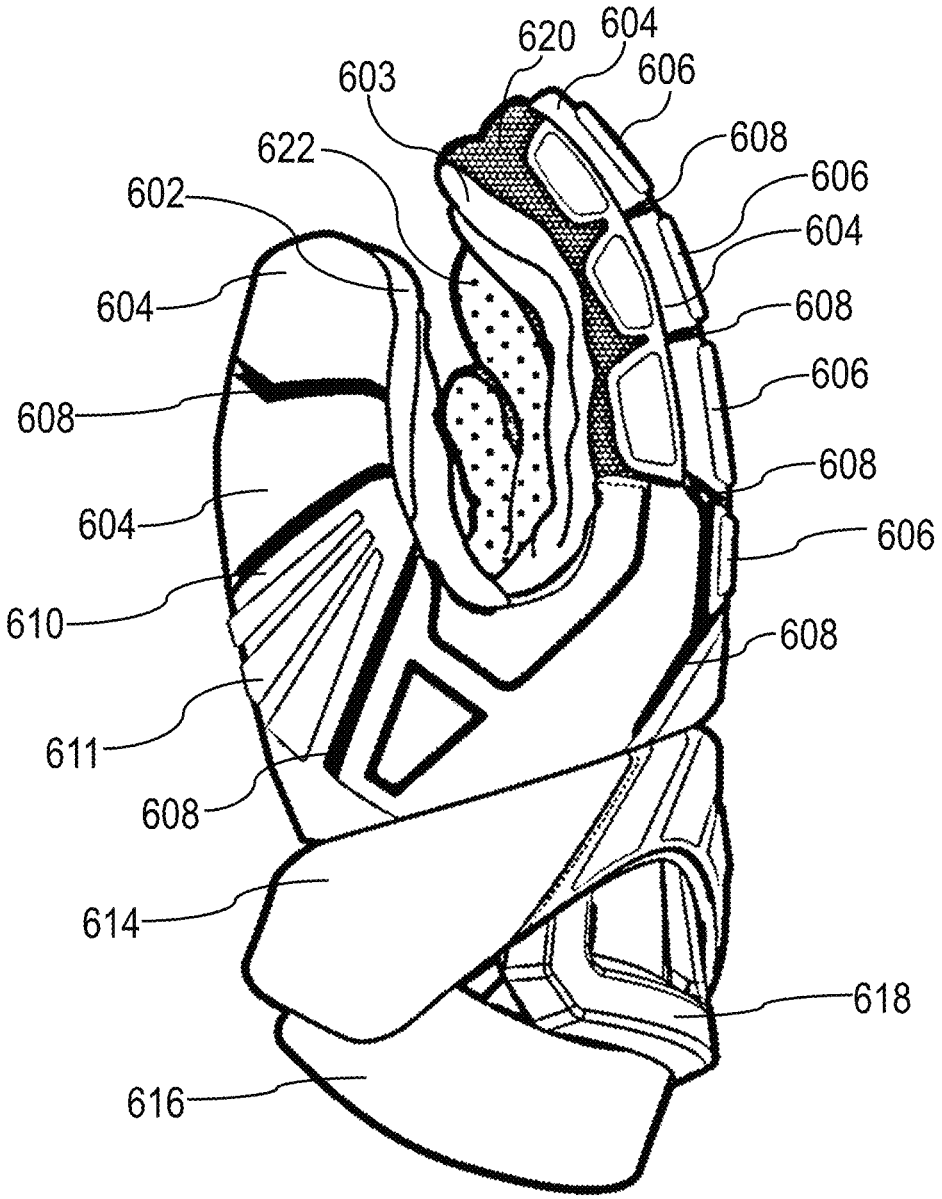
FIG. 18B is a side view of the glove of FIG. 18A.
Figure 18C:
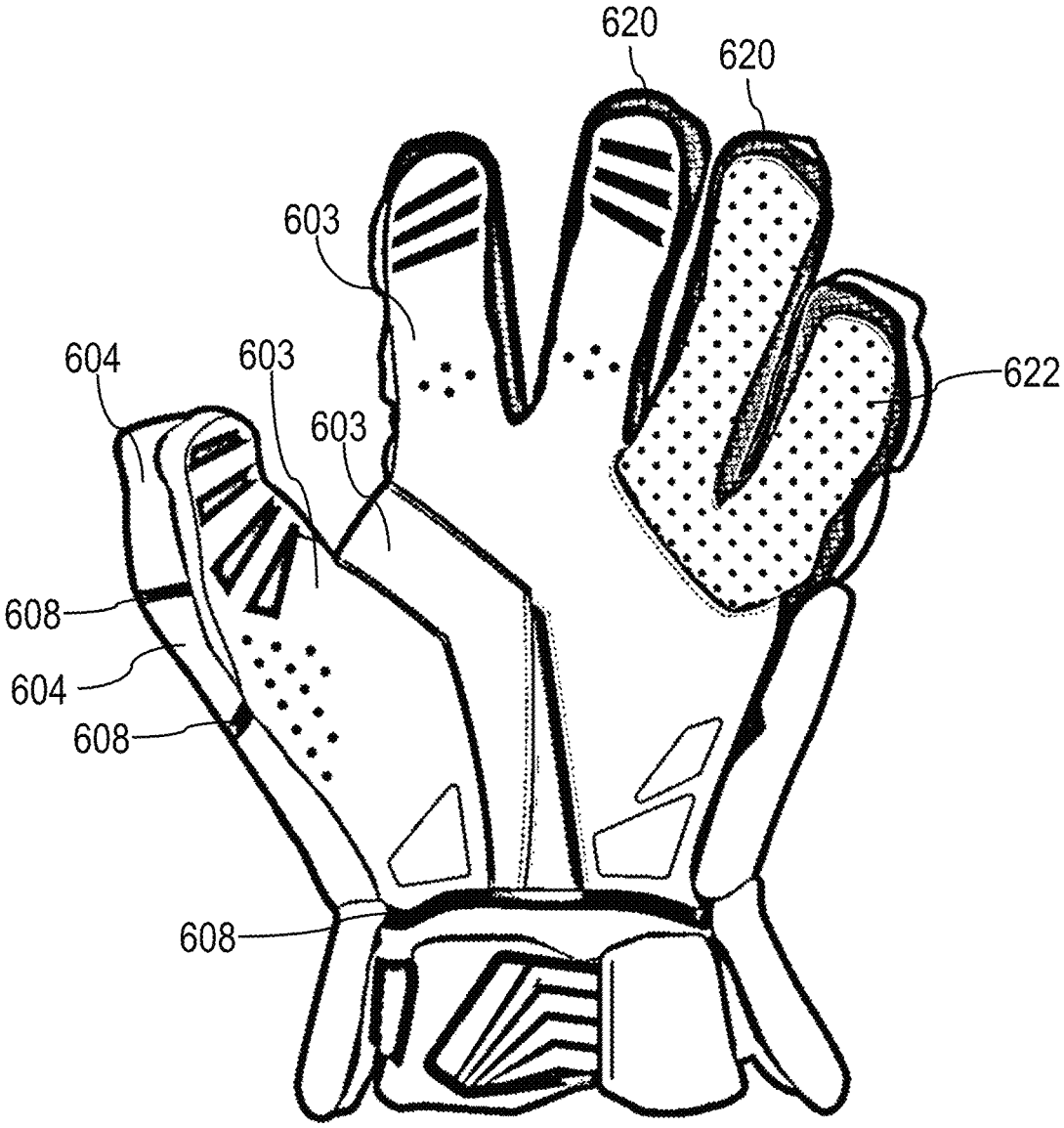
FIG. 18C is a palmar view of the glove of FIG. 18A.

FIG. 18A is a dorsal view, FIG. 18B is a side view, and FIG. 18C is a palmar view of another embodiment of a glove 600. As shown in FIG. 18A, the glove is similar to embodiments previously discussed, in that the glove includes a hand body 602 including a hand pad pocket configured to receive a plurality of hand pads. According to the embodiment of FIG. 18A, the hand pad pocket is not shown, and as in the embodiment of FIGS. 18A-18C the hand pad pocket is sewn shut once the hand pads are inserted in the hand pad pocket. Accordingly, the hand pads are not removeable without damaging the glove once the glove 600 is fully assembled as shown in FIGS. 18A-18C. According to the embodiment of FIGS. 18A-18C, the glove 600 includes a wrist pad 614 and a wrist cuff 616. Similar to previously described embodiments, the wrist pad 614 may include a wrist pad pocket configured to receive wrist padding. The wrist cuff 616 may keep the glove 600 attached to the user's wrist when the glove is removed, and the wrist cuff may be attached to the hand body via tethers. As shown in FIGS. 18B-18C, the glove also includes high wear portions 603 for certain grip areas of the palmar side of the glove, similar to other embodiments described herein. The glove also includes perforated portions 622 configured to promote breathability of the glove in certain regions. The glove also includes a pull handle 618, which may assist a user with putting on the glove (e.g., inserting a hand through a hand opening of the hand body 602).

In contrast to some other embodiments discussed herein, the glove of FIGS. 18A-18C includes a plurality of raised pads 604 applied to an external surface of the hand body 602. The raised pads 604 are formed by a heat-welded layer 606 welded to the hand body 602 and attaching foam to the hand body 602. The heat-welded layer 606 may be formed of thermoplastic polyurethane (TPU) or another suitable material. The raised pads may offer additional protection for specific areas of the hands (e.g., the fingers). Furthermore, the heat-welded layer 606 may provide enhanced wear resistance compared to the hand body 602. As shown in FIG. 18A, each of the plurality of raised pads are separated from one another by interstitial portions 608, where the external surface of the hand body 602 is the outermost layer. These interstitial portions may be flexible, so that the flexibility of the glove is maintained. As will be discussed further below, the interstitial portions may be aligned with breaks in the hand pads disposed in the hand body, so that the most flexible portions of the hand body are aligned with the most flexible portions of the hand pads. As shown in FIGS. 18A-18B, the glove 600 may include any number of raised pads 604 suitable to provide wear resistance and supplementary protection for certain areas of the hand. Correspondingly, the glove may include any suitable number of interstitial portions 608 to provide appropriate flexibility to the glove to enable full range of motion for a user when worn. An exemplary process of forming raised pads will be described further with reference to FIGS. 21A-21C.

In some embodiments as shown in FIGS. 18A-18B, the breaks in the hand pad and the interstitial portions 608 may be aligned with knuckle regions of the glove 600. The knuckle regions are configured to bend when a finger of the glove is bent. The knuckle regions may be configured to be aligned with a wearer's actual knuckle in some embodiments. However, in other embodiments a knuckle region of a glove may not be aligned with a wearer's actual knuckle, as the present disclosure is not so limited in this regard.

As shown in FIGS. 18A-18B, the glove 600 may also include one or more wear patches 610. The wear patches may be similar to the raised pads 604, except that the wear patches lack the foam between the heat molded layer and the hand body 602. The wear patches 610 may also be formed of a heat weldable material (e.g., TPU) and may function to provide enhanced wear compared to the hand body. As shown in FIG. 18A, the wear patches may also include ridges 611 or other texturing that may further enhance wear durability compared to the hand body alone. In some embodiments as shown in FIG. 18A, the wear patches may also accommodate rigid plates 612 which may further provide additional wear durability and/or protection for a user's hand. Of course, while the glove 600 includes wear patches 610, in other embodiments the wear patches may be replaced with raised pads, as the present disclosure is not so limited. Likewise, in some embodiments the raised pads 604 may be replaced with wear patches, as the present disclosure is not so limited.

According to the embodiment of FIGS. 18A-18C, the fingers of the glove 600 include elastic portions 620 configured to expand when a hand pad is inserted into the hand body 602. In some cases, the fingers of the glove 600 may resist the insertion of hand pads, especially as the hand pads near full insertion into the glove body. The expandability of the elastic portions 620 reduces this resistance to insertion, allowing the hand pads to be reliably and quickly inserted into the glove 600. In some embodiments, the elastic portions are configured as spandex or another suitable elastic material that stretches in one or more dimensions.

Figure 19A:
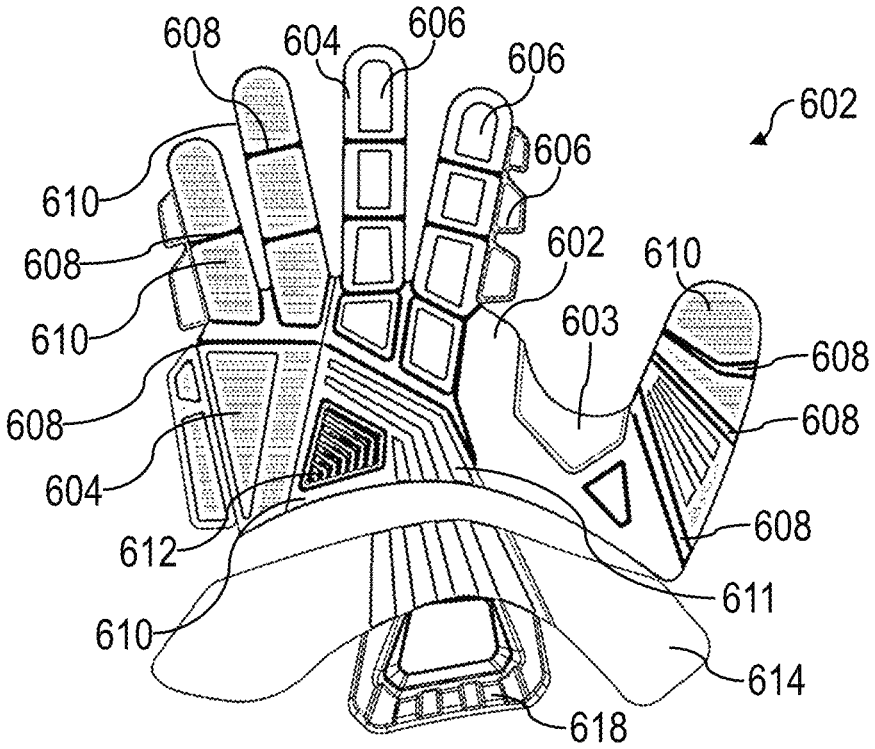
FIG. 19A is a dorsal view of one embodiment of a hand body.
Figure 20A:
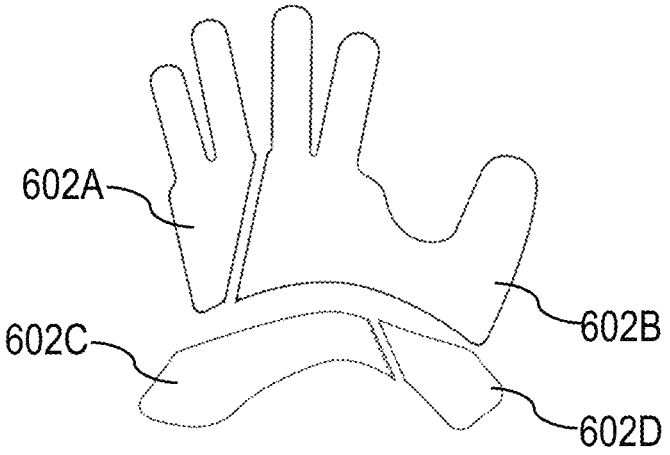
FIG. 20A is a plan view of one embodiment of a base layer of a hand body.

FIG. 19A is a dorsal view of one embodiment of a hand body 602 more clearly showing the arrangement of the various components of the glove of FIG. 20A. As shown in FIG. 19A, the hand body 602 includes a plurality of raised pads 604 which are attached to an external (e.g., dorsal) portion of the hand body with heat welding. Each of the raised pads includes at least one foam layer attached to the hand body with a heat-welded layer (e.g., TPU). The interstitial portions 608 of the hand body between the raised pads allows for flexibility of the hand body, as the heat-welded layers 606 may be less flexible than the material of the hand body. In some embodiments, the interstitial portions are formed of spandex or another suitably elastic material. The hand body also include a plurality of wear patches 610 which may also be heat welded to the external surface of the hand body. The wear patches may be formed of the same material as the heat-welded layer (e.g., TPU) or another suitable material. The interstitial portions 608 may also extend between the wear patches to provide flexibility.

As shown in FIG. 19A, the hand body 602 may be assembled in a plan configuration as shown. Accordingly, the various raised pads 604 and wear patches 610 may be easily attached to the hand body 602 with a heat press. The heat-welded layers 606 and wear patches 610 may be easily swapped out to form different hand body types. For example, the heat-welded layers and/or wear patches may be selected from a plurality of different types, which may differ in color, graphics, texture, etc. Accordingly, a hand body of a different type may be easily produced by attaching various heat-welded layers and/or wear patches to the hand body 602 to alter the overall appearance, texture, or construction of the hand body. In this manner, customized gloves may be rapidly produced using a single underlying hand body and a single type of hand pad.

Figure 19B:
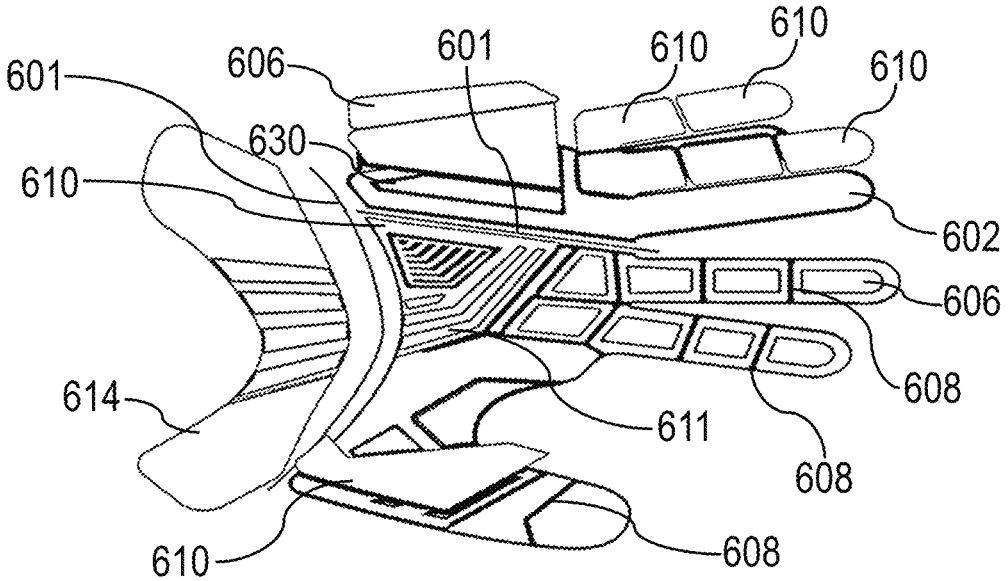
FIG. 19B is an exploded view of the hand body of FIG. 19A.

FIG. 19B is an exploded view of the hand body 602 of FIG. 19A. FIG. 19B shows the layered construction of the hand body, with the some of the wear patches 610 and heat-welded layers 606 separated from the hand body 602. As shown in FIG. 19B, the heat-welded layers cover foam layers 630 that are positioned between the hand body 602 and the heat-welded layers. The heat-welded layers may secure the foam in place on the hand body to provide additional protection for the user, and/or to alter the appearance of the external surface of the hand body. According to the embodiment of FIG. 19B, the hand body 602 may be formed of a multi-piece construction that may be sewn together to form a three-dimensional shape at one or more seams 601. Of course, a hand body 602 may be formed of any suitable number of pieces, including a single piece, as the present disclosure is not so limited.

FIG. 20A is a plan view of one embodiment of a base layer of a hand body. As shown in FIG. 20A, the hand body may be formed in four separate portions, which then may be attached to one another to form a complete hand body (e.g., via sewing). In the embodiment of FIG. 20A, the hand body include a pinky and ring finger portion 602A, an index and thumb portion 602B, a first wrist portion 602C, and a second wrist portion 602D. In some embodiments, the hand body may be formed of an elastic material, such as spandex.

Figure 20B:
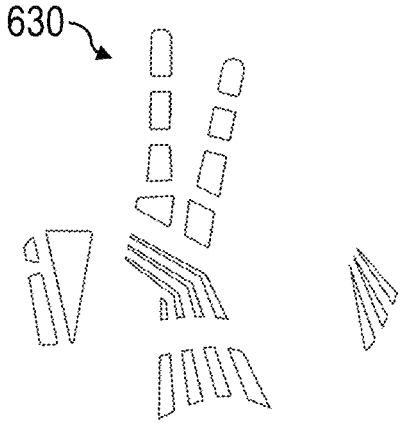
FIG. 20B is a plan view of one embodiment of foam layers of a plurality of raised pads for attachment to the hand body of FIG. 20A.
Figure 20C:
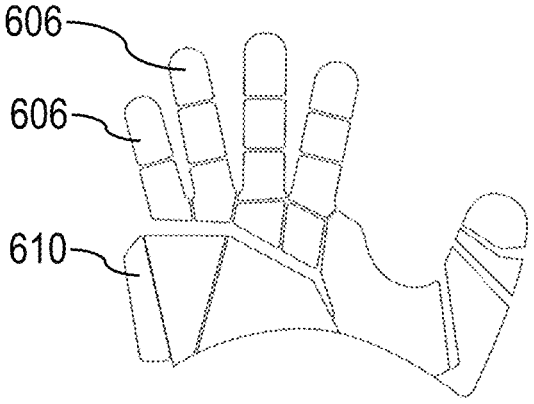
FIG. 20C is a plan view of one embodiment of a heat-welded layer for attachment to the hand body of FIG. 20A.

FIG. 20B is a plan view of one embodiment of foam layers 630 of a plurality of raised pads, and FIG. 20C is a plan view of one embodiment of heat-welded layers 606 and wear patches 610 for attachment to the hand body of FIG. 20A. As shown in FIG. 20B, the foam layers 630 may be distributed in areas to provide additional protection to the hand body, and may also provide texture or markings apparent externally to a user. The heat-welded layers 606 are configured to secure the foam the hand body, where each of the heat-welded layers are separate from one another to provide flexibility. Likewise, the wear patches 610 may be attached to the hand body and may be separated from one another to provide flexibility to the hand body.

Figure 21A:
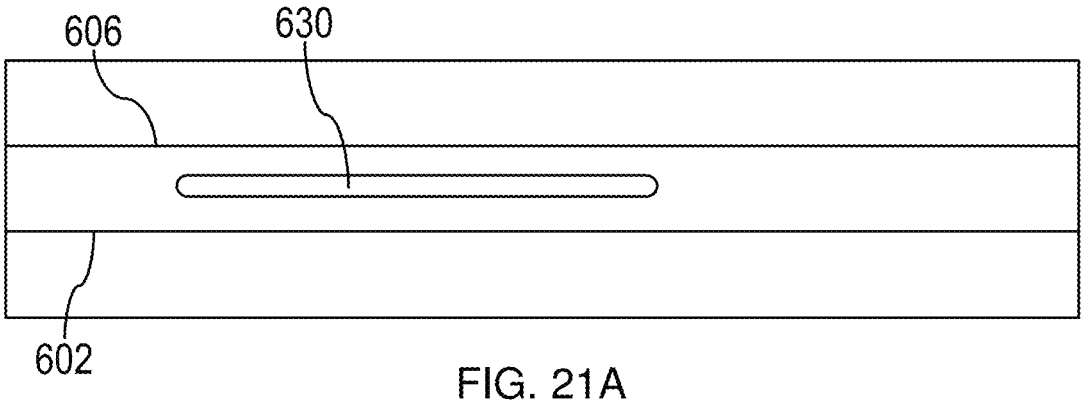
FIG. 21A shows a first step of a heat welding process for a glove.
Figure 21B:
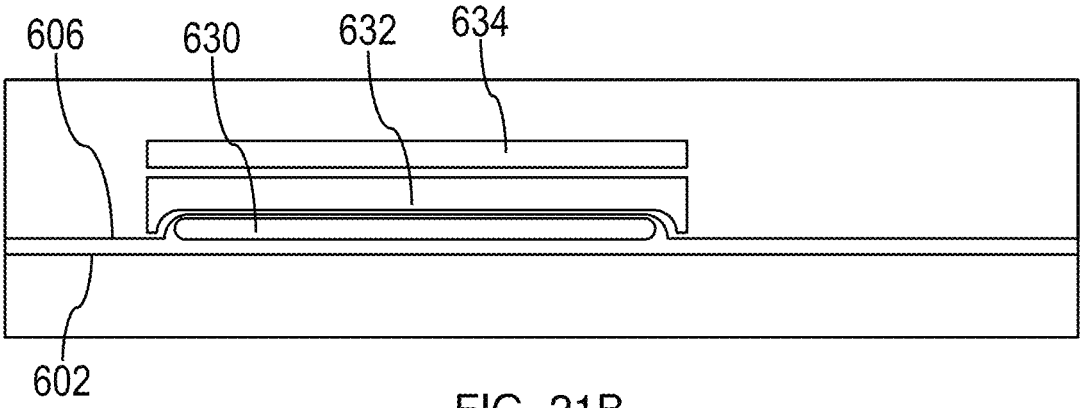
FIG. 21B shows a second step of a heat welding process for a glove.
Figure 21C:
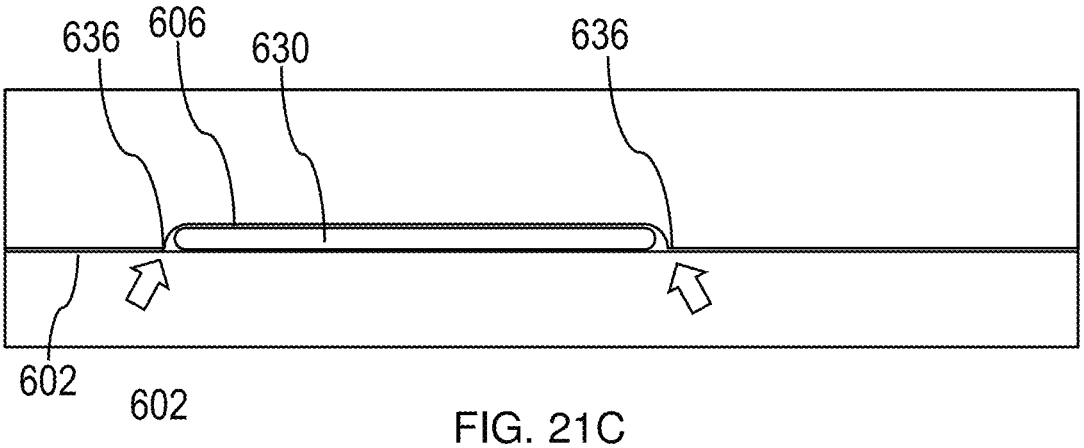
FIG. 21C shows a third step of a heat welding process for a glove.

FIGS. 21A-21C show an exemplary method of heat welding a raised pad onto a hand body 602. As shown in FIG. 21A, a foam layer 630 is positioned between the hand body 602 and a heat weldable layer 606. The foam layer 630 may be positioned on an external (e.g., dorsal) surface of the hand body. As shown in FIG. 21B, a mold plate 632 is positioned over the heat weldable layer along with a heat plate 634. The mold plate is shaped to provide space for the foam layer 630 to expand after pressing and heat welding the heat weldable layer 606 to the hand body 602. The heat plate 634 is configured to apply heat to the heat weldable layer through the mold to heat weld the heat weldable layer 606 to the hand body 602. As shown in 21C, after the mold and heat plate are applied to the heat weldable layer, the foam layer 630 is attached to the hand body by the heat weldable layer. In particular, seals 636 are created were the heat weldable layer 606 and hand body touch. The process shown in FIGS. 21A-21C may be expanded to accommodate multiple foam layers and heat weldable layers simultaneously with a larger mold plate and heat plate. Accordingly, a plurality of raised pads may be attached to a hand body in a rapid manner, without stitching or adhesives. In some embodiments, one or more wear patches may be attached to a hand body in a similar manner, except that there may be no mold plate, or the mold plate may not provide any volume for the foam when applying heat to a wear patch.

Figure 22A:
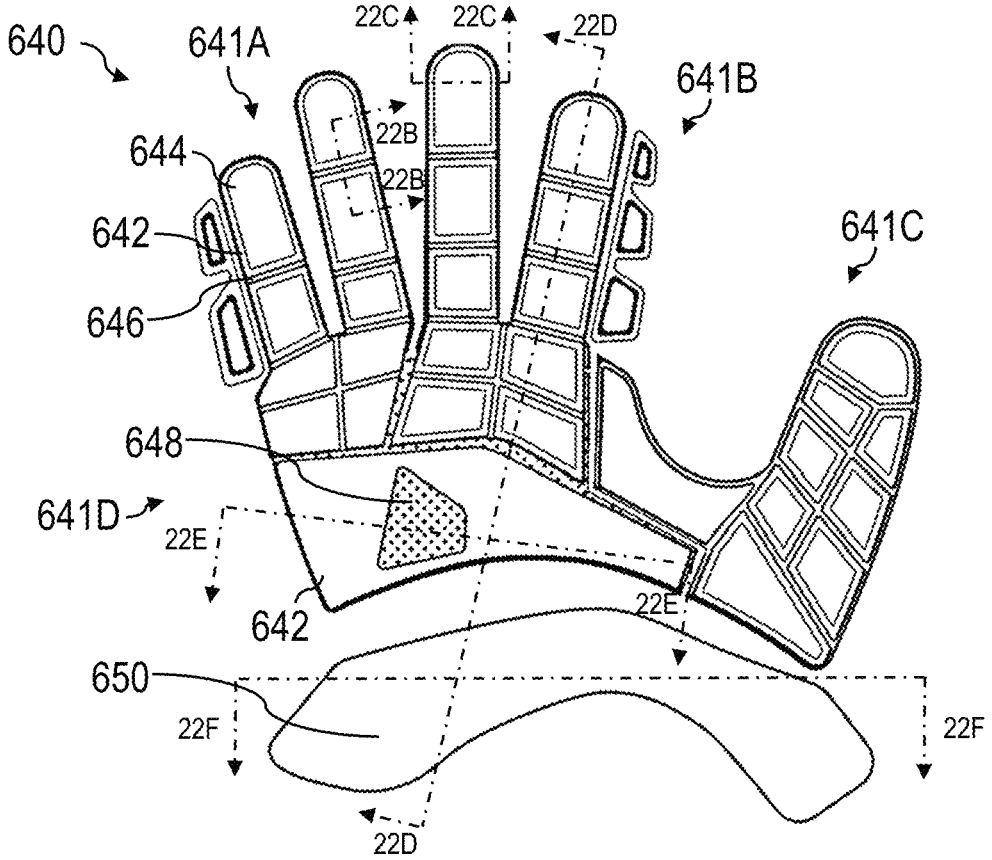
FIG. 22A is a plan view of one embodiment of a plurality of hand pads for a glove.

FIG. 22A is a plan view of one embodiment of a plurality of hand pads 640 for a glove. According to the embodiment of FIG. 22A, the hand pads have a multi-layered construction configured to allow for a combination of flexibility and protection for a user. Additionally, as will be discussed further with reference to FIG. 22D, the hand pads are configured to interlock to facilitate appropriate alignment in a hand body. As shown in FIG. 22A, the hand pads are separated into a pinky and ring finger portion 641A, an index and middle finger portion 641B, a thumb portion 641C, and a dorsal portion 641D. These four portions collectively are configured to occupy a hand pocket of a glove. According to the embodiment of FIG. 22A, the hand pads includes a base foam layer 648 which is configured to be flexible.

Additionally, in some embodiments, as shown by way of example in FIG. 22A, the base foam layer is perforated to allow for breathability. The hand pads also include high-density foam layers 642 attached to a dorsal side of the base foam layer. The high-density foam layers may provide the majority of the protection in the glove, and may be formed of any suitable foam material, including, but not limited to, high-density polyethylene foam. As shown in FIG. 22A, the finger portions of the hand pads 640 may further include rigid plates 644 attached to a dorsal side of the high-density foam layers. The rigid plates may be formed of a suitably rigid material, such as rigid polyethylene. The rigid plates may be thin relative to the high-density layer or base layer. For example, the rigid plates may form approximately 5-10% of the total thickness of the hand pad. As shown in FIG. 22A, the rigid plates 644 may be selectively placed on portions of the hand pads where additional protection is desired. In other embodiments, no rigid plates may be employed, as the present disclosure is not so limited. As shown in FIG. 22A, the hand pads include breaks 646 formed in between the high-density foam layers and the rigid plates 644. In this manner, the base foam layer is the only foam layer that extends continuously throughout a hand pad portion in some embodiments. Additionally, the breaks may extend part of the way through an entire thickness of the hand pads in some embodiments. The breaks 646 provide flexibility to the hand pads. In some embodiments, the breaks 646 may be aligned with interstitial regions of a hand body (e.g., see FIGS. 18A-18C).

According to the embodiment of FIG. 22A, the hand pads 640 include a wrist pad 650 configured to be inserted into a wrist pad pocket. The wrist pad also has a multi-layered construction, as will be discussed further with reference to FIGS. 22D and 22F.

Figure 22B:
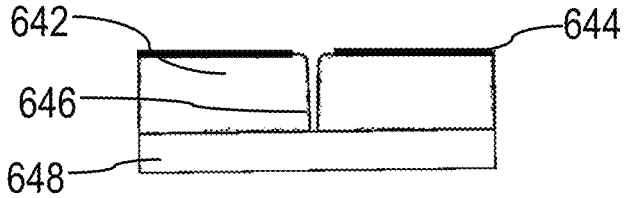
FIG. 22B is a cross-sectional view of the plurality of hand pads of FIG. 22A taken along line 22B-22B.

FIG. 22B is a cross-sectional view of the plurality of hand pads of FIG. 22A taken along line 22B-22B. As shown in FIG. 22B, the high-density foam layers 642 are attached on a dorsal side of the base foam layer 648. The rigid plates 644 are attached to a dorsal side of the high-density foam layers. A break 646 extends through part (e.g., a majority) of the overall thickness of the hand pad, allowing the hand pad to flex in predetermined regions. As noted previously, in some embodiments the breaks 646 are aligned with flexible interstitial portions of a hand body. While in the embodiment of FIG. 22B the breaks are shown as completely separating the high-density layers by extending to the base foam layer 648, in other embodiments the breaks may not extend all the way through the high-density layers, as the present disclosure is not so limited. In such an arrangement, the various high-density layers may form a continuous layer in a hand pad portion.

Figure 22C:
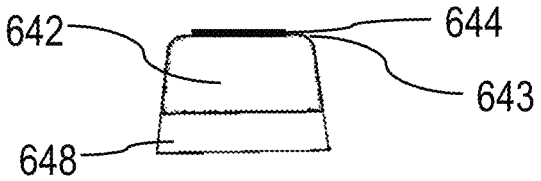
FIG. 22C is a cross-sectional view of the plurality of hand pads of FIG. 22A taken along line 22C-22C.

FIG. 22C is a cross-sectional view of the plurality of hand pads of FIG. 22A taken along line 22C-22C. FIG. 22B depicts the shape of the foam layer which assists in insertion of the hand pads into a hand pad pocket. As shown in FIG. 22C, the high-density foam has angled sides and rounded top corners 643. Accordingly, the high-density foam as a trapezoidal shape. The rigid plate 644 does not extend to the corners 643 so as to provide compressibility at the outermost portions of the hand pad for facilitating insertion of the hand pad into a hand body. Such an arrangement also improves the flexibility of the hand body.

Figure 22D:
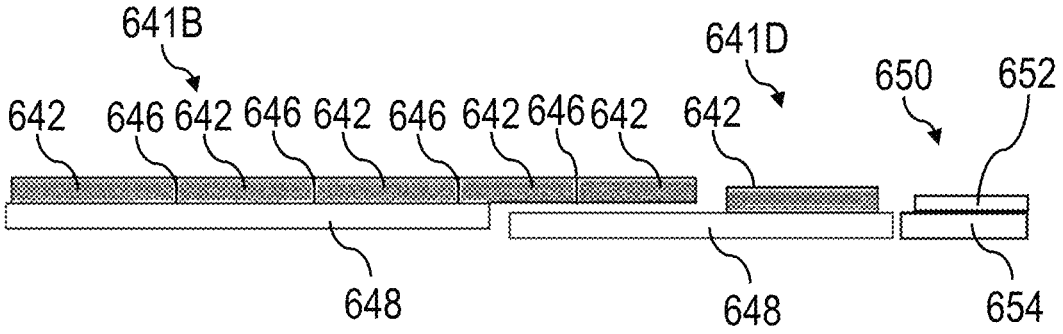
FIG. 22D is a cross-sectional view of the plurality of hand pads of FIG. 22A taken along line 22D-22D.

FIG. 22D is a cross-sectional view of the plurality of hand pads of FIG. 22A taken along line 22D-22D. As shown in FIG. 22D, the hand pads include an overlapping arrangement configured to simplify alignment of the hand pads in a hand body pocket during assembly. As shown in FIG. 22D, the high-density foam layers 642 of the index and middle finger portion 641B extend past the base foam layer 648. In contrast, the base foam layer 648 of the dorsal portion 641D extends past the high-density foam layer 648. Accordingly, the base foam layer 648 of the dorsal portion 641D is configured to receive the high-density foam layers of the index and middle finger portion 641B. Accordingly, the various hand pad portions may fit together in this manner to self-align inside of a hand pad pocket. In other embodiments, there may be no overlap between hand pad portions, as the present disclosure is not so limited.

As shown in FIG. 22D, the wrist pad 650 also includes a multi-layered construction. In particular, similar to the hand pad portions, the wrist pad is formed by a base foam layer 654 formed of a flexible foam and a high-density foam layer 652 formed of a more rigid foam (e.g., high-density polyethylene foam). The wrist pad may accordingly provide protection for a user while retaining flexibility.

Figure 22E:
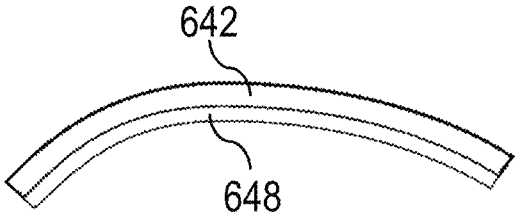
FIG. 22E is a cross-sectional view of the plurality of hand pads of FIG. 22A taken along line 22E-22E.

FIG. 22E is a cross-sectional view of the plurality of hand pads of FIG. 22A taken along line 22E-22E. According to the embodiment of FIG. 22E, a hand pad portion may be formed in a curved shaped using otherwise flat pieces of foam. As shown in FIG. 22E, curvature may be generated by the use of base foam layer 648 having a dimension (e.g., width) which is less than the same dimension of the high-density foam layer 642. Accordingly, when the edges of the foam layers are aligned, the combined layers may take a curved shape as shown in FIG. 22E. Thus, by adhering two layers of foam together, hand pad portions may be curved to approximately match the curvature of a hand body and/or a user's hand. In other embodiments the hand pad portions may be flat, as the present disclosure is not so limited. Additionally, in still other embodiments, a hand pad may be molded into a desired three-dimensional or flat shape during manufacturing. In other embodiments, a hand pad may be formed of a single layer, as the present disclosure is not so limited.

Figure 22F:
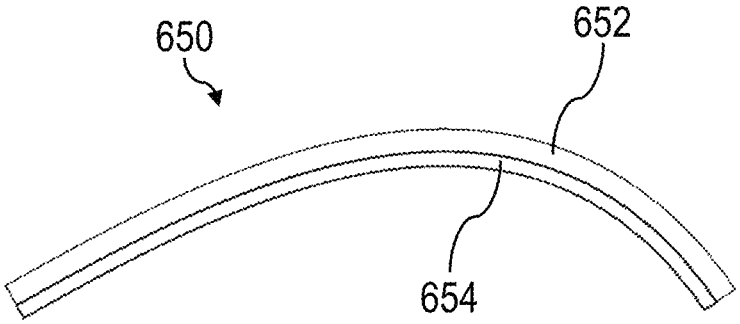
FIG. 22F is a cross-sectional view of the plurality of hand pads of FIG. 22A taken along line 22F-22F.

FIG. 22F is a cross-sectional view of the plurality of hand pads of FIG. 22A taken along line 22F-22F. As shown in FIG. 22F, the wrist pad 650 may also have curvature generated by a multi-layer construction. In particular, the base foam layer 654 may have a dimension (e.g., width) less than the same dimension of the high-density foam layer 652. Accordingly, when the ends of the foam layers are aligned and adhered together, the wrist pad may take the curved shaped shown in FIG. 22F. In other embodiments the wrist pad may be flat, as the present disclosure is not so limited. Additionally, in still other embodiments, a wrist may be molded into a desired three-dimensional or flat shape during manufacturing. In other embodiments, a wrist pad may be formed of a single layer, as the present disclosure is not so limited.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only

What is claimed is:

1. A protective glove comprising:

a hand body having an interior, the hand body being formed of an at least partially elastic material, wherein the hand body defines a hand pocket configured to receive a user's hand, wherein the hand body comprises a plurality of interstitial portions, wherein the plurality of interstitial portions are formed of the at least partially elastic material;

a plurality of raised pads attached to an external surface of the hand body, wherein the interstitial portions are positioned between the plurality of raised pads, and wherein the interstitial portions are more elastic than the plurality of raised pads;

a wrist body;

a first hand pad comprising a dorsal portion attached to a first finger portion and a second finger portion, wherein the first finger portion and the second finger portion are separated from one another, and wherein the first hand pad is a single piece;

a second hand pad comprising a dorsal portion attached to a third finger portion and a fourth finger portion, wherein the third finger portion and the fourth finger portion are separated from one another, and wherein the second hand pad is a single piece; and a hand pad pocket formed in the interior of the hand body and configured to receive and retain the first hand pad and the second hand pad, wherein the hand pad pocket is separated from the hand pocket by a separator.

2. The protective glove of claim 1, wherein the hand pad pocket is disposed adjacent a dorsal portion of the protective glove and the hand pocket is disposed adjacent a palmar portion of the protective glove.

3. The protective glove of claim 1, further comprising a wrist pad pocket formed in the wrist body configured to receive and retain at least one wrist pad.

4. The protective glove of claim 3, wherein the hand pad pocket includes a hand pad pocket opening and the wrist pad pocket includes a wrist pad pocket opening, and wherein the hand pad pocket opening and the wrist pad pocket opening are adjacent to one another.

5. The protective glove of claim 4, wherein the first hand pad includes the at least one wrist pad, wherein the hand pad pocket and the wrist pad pocket are configured to simultaneously receive the first hand pad through the hand pad pocket opening and the wrist pad pocket opening.

6. The protective glove of claim 4, wherein the hand pad pocket opening is configured to retain the first hand pad and the second hand pad in the hand pad pocket without permanently closing the hand pad pocket opening.

7. The protective glove of claim 4, further comprising the at least one wrist pad, wherein the wrist pad pocket opening is configured to retain the wrist pad in the wrist pad pocket without permanently closing the wrist pad pocket opening.

8. The protective glove of claim 3, further comprising the at least one wrist pad, wherein the at least one wrist pad is three wrist pads, wherein the wrist pad pocket includes three sections, wherein each section of the three sections is configured to receive a separate wrist pad of the three wrist pads.

9. The protective glove of claim 1, wherein the plurality of raised pads includes foam attached to the external surface of the hand body with a heat-welded layer, wherein the plurality of raised pads are separated from one another.

10. The protective glove of claim 1, further comprising:

a plurality of wear patches applied to the external surface of the plurality of raised pads with a heat-welded layer, wherein the plurality of wear patches are separated from one another, wherein the interstitial portions are positioned between the plurality of wear patches, wherein the interstitial portions are more elastic than the plurality of wear patches.

11. The protective glove of claim 1, wherein the hand pad pocket comprises a hand pad pocket opening to receive the first hand pad and the second hand pad, wherein the first hand pad and the second hand pad are positioned within the hand pad pocket, wherein the hand pad pocket opening is permanently closed.

12. The protective glove of claim 1, wherein the hand pad pocket comprises a hand pad pocket opening to receive the first hand pad and the second hand pad, wherein the first hand pad and the second hand pad are positioned within the hand pad pocket, wherein the hand pad pocket opening is selectively closed such that the first hand pad and the second hand pad are removable from the hand pad pocket without damaging the hand pad pocket.

13. The protective glove of claim 1, wherein the hand pad pocket comprises a hand pad pocket opening to receive the first hand pad and the second hand pad, wherein the hand pad pocket opening is positioned in the interior of the hand body.

14. The protective glove of claim 1, wherein the hand pocket includes a finger region extending from at least proximal to a first knuckle region to at least distal to a second knuckle region.

15. The protective glove of claim 14, wherein the first finger portion is received in the finger region, and the first finger portion is a continuous member extending from at least proximal to the first knuckle region to at least distal to the second knuckle region.

16. The protective glove of claim 15, wherein the first finger portion comprises a break between a first portion and a second portion of the first finger portion, where the break aligns with the first knuckle region, and wherein an interstitial portion of the plurality of interstitial portions aligns with the break.

17. The protective glove of claim 1, wherein:

the hand pocket includes a first finger region, a second finger region, a third finger region, and a fourth finger region each separated from one another, the first finger portion is positioned in the first finger region, the second finger portion is positioned in the second finger region, the third finger portion is positioned in the third finger region, and the fourth finger portion is positioned in the fourth finger region.

18. A protective glove comprising:

a hand body, the hand body being formed of an at least partially elastic material, wherein the hand body defines a hand pocket configured to receive a user's hand, wherein the hand body comprises a plurality of interstitial portions, wherein the plurality of interstitial portions are formed of the at least partially elastic material;

a plurality of raised pads attached to an external surface of the hand body, wherein the interstitial portions are positioned between the plurality of raised pads, and wherein the interstitial portions are more elastic than the plurality of raised pads;

a first hand pad comprising a dorsal portion attached to a first finger portion and a second finger portion, wherein the first finger portion and the second finger portion are separated from one another, and wherein the first hand pad is a single piece;

a second hand pad comprising a dorsal portion attached to a third finger portion and a fourth finger portion, wherein the third finger portion and the fourth finger portion are separated from one another, and wherein the second hand pad is a single piece; and a hand pad pocket formed in the hand body and configured to receive and retain the first hand pad and the second hand pad, wherein the hand pad pocket is separated from the hand pocket by a separator.

19. The protective glove of claim 18, wherein the plurality of raised pads includes foam attached to the external surface of the hand body with a heat welded layer.

20. The protective glove of claim 18, wherein the hand pad pocket is positioned in an interior of the hand body.

21. The protective glove of claim 18, wherein each of the first finger portion and the second finger portion is configured to extend across two different knuckle regions of the hand body, and wherein each of the third finger portion and the fourth finger portion extend across two different knuckle regions of the hand body.

22. The protective glove of claim 18, further comprising:

a plurality of wear patches applied to the external surface of the plurality of raised pads with a heat-welded layer, wherein the plurality of wear patches are separated from one another.

23. A protective glove comprising:

a hand body defining a hand pocket configured to receive a user's hand, wherein the hand body is formed of an at least partially elastic material;

at least one hand pad positioned on an interior of the hand body, the at least one hand pad including one or more breaks;

one or more interstitial portions aligned with the one or more breaks, wherein the one or more interstitial portions are formed of the at least partially elastic material, wherein the one or more interstitial portions are more elastic than surrounding portions of the protective glove; and a plurality of wear patches applied to an external surface of the hand body with a heat-welded layer, wherein the plurality of wear patches are separated from one another.

24. The protective glove of claim 23, further comprising a plurality of raised pads applied to an external surface of the hand body, wherein each of the plurality of raised pads includes foam attached to the external surface of the hand body with a heat welded layer.

25. The protective glove of claim 24, wherein the one or more interstitial portions are positioned between the plurality of raised pads.

26. The protective glove of claim 23, wherein the at least one hand pad comprises a low-density foam layer and a plurality of high-density foam layers disposed on the low-density foam layer, and wherein the one or more breaks are positioned between the high-density foam layers.

27. The protective glove of claim 26, wherein the high-density foam layers are completely separated from one another by the one or more breaks.

* * * * *